US007717838B2

(12) United States Patent
Strong et al.

(10) Patent No.: US 7,717,838 B2
(45) Date of Patent: May 18, 2010

(54) BLANK AND METHODS AND APPARATUS FOR FORMING A DISPENSER CASE FROM THE BLANK

(75) Inventors: Benjamin D. Strong, Covington, GA (US); Brian C. Lowe, Smyrna, GA (US)

(73) Assignee: Smurfit-Stone Container Enterprises, Inc., Chicago, IL (US)

( * ) Notice: Subject to any disclaimer, the term of this patent is extended or adjusted under 35 U.S.C. 154(b) by 0 days.

(21) Appl. No.: 11/303,395

(22) Filed: Dec. 16, 2005

(65) Prior Publication Data

US 2007/0142193 A1 Jun. 21, 2007

(51) Int. Cl.
*B31B 1/28* (2006.01)

(52) U.S. Cl. ..... 493/175; 493/176; 493/162; 493/126; 493/127

(58) Field of Classification Search ..... 493/55, 493/124–127, 143, 162–163, 167, 174–179
See application file for complete search history.

(56) References Cited

U.S. PATENT DOCUMENTS

| | | | | |
|---|---|---|---|---|
| 1,645,771 | A | | 10/1927 | Pillsbury |
| 1,988,064 | A | | 1/1935 | Wiemann |
| 2,556,707 | A | | 6/1951 | Rendall et al. |
| 2,568,725 | A | | 9/1951 | Fey |
| 2,676,746 | A | | 4/1954 | Kellogg et al. |
| 2,770,408 | A | | 11/1956 | Lindeberg |
| 2,803,390 | A | | 8/1957 | MacKay |
| 2,907,512 | A | | 10/1959 | Leone |
| 3,161,341 | A | | 12/1964 | Farquhar |
| 3,207,380 | A | | 9/1965 | Hennessey |
| 3,478,948 | A | | 11/1969 | Dornbush |
| 3,568,911 | A | | 3/1971 | Bebout |
| 3,593,908 | A | | 7/1971 | Desmond et al. |
| 3,944,128 | A | | 3/1976 | Hogan |
| 4,039,118 | A | | 8/1977 | Kawaoka |
| 4,138,051 | A | | 2/1979 | Zicko |
| 4,283,000 | A | | 8/1981 | White |
| 4,500,306 | A | * | 2/1985 | Nowacki ..... 493/92 |
| 4,530,548 | A | | 7/1985 | Spamer et al. |
| 4,602,735 | A | | 7/1986 | Aaron |
| 4,658,984 | A | | 4/1987 | Brunner |
| 4,739,922 | A | | 4/1988 | Zimmermann |
| 4,752,029 | A | | 6/1988 | Buford |
| 4,805,765 | A | | 2/1989 | Barrett et al. |
| 4,899,929 | A | | 2/1990 | Grollman |
| 4,921,104 | A | | 5/1990 | Holmes |
| 5,020,719 | A | | 6/1991 | Roth et al. |
| 5,024,641 | A | * | 6/1991 | Boisseau ..... 493/171 |
| 5,147,271 | A | | 9/1992 | Bacques et al. |
| 5,160,307 | A | | 11/1992 | Bacques et al. |
| 5,238,181 | A | | 8/1993 | Mahler |

(Continued)

*Primary Examiner*—Christopher Harmon
(74) *Attorney, Agent, or Firm*—Armstrong Teasdale LLP

(57) ABSTRACT

A machine for forming a case from a blank of sheet material includes a body, a mandrel mounted on the body and having an external shape complimentary to an internal shape of at least a portion of the case, a member mounted on the body adjacent the mandrel for applying a force to the blank for at least one of folding a portion of the blank around the mandrel, moving the blank, and securing portions of the blank together, and a servomechanism operatively connected to the member for driving and controlling movement of the member to apply the force to the blank.

20 Claims, 22 Drawing Sheets

U.S. PATENT DOCUMENTS

| | | | | |
|---|---|---|---|---|
| 5,328,082 | A | 7/1994 | Fritz et al. | |
| 5,458,272 | A | 10/1995 | Ward-Weber | |
| 5,626,283 | A | 5/1997 | Mellon | |
| 5,704,540 | A | 1/1998 | Coalier et al. | |
| 5,860,517 | A | 1/1999 | Gemma, Jr. et al. | |
| 5,878,946 | A | 3/1999 | Frerot et al. | |
| 6,105,854 | A | 8/2000 | Spivey et al. | |
| 6,189,778 | B1 | 2/2001 | Kanter | |
| 6,385,950 | B1 * | 5/2002 | Anderson | 53/563 |
| 6,387,028 | B1 * | 5/2002 | Nishio et al. | 493/165 |
| 2003/0098344 | A1 | 5/2003 | Blake | |
| 2003/0146270 | A1 | 8/2003 | Caille et al. | |
| 2003/0226879 | A1 | 12/2003 | Auclair et al. | |
| 2004/0074954 | A1 | 4/2004 | Fogle et al. | |

* cited by examiner

BLANK AND METHODS AND APPARATUS FOR FORMING A DISPENSER CASE FROM THE BLANK

BACKGROUND OF THE INVENTION

This invention relates generally to cases formed from sheet material, and more specifically to dispenser cases, blanks of sheet material for producing dispenser cases, and methods and apparatus for forming dispenser cases.

Paperboard dispensers are often used to dispense multiple individual articles, such as confectionary products (e.g., candy, gum, etc.), bulk products, food condiments (e.g., packets of sugar, salt, ketchup, mustard, etc.), or other dispensable articles. The dispenser is usually filled with the articles and closed for transportation to a home, restaurant, or retail store. Once at the home, restaurant, or store the dispenser is opened and the articles can be removed therefrom for purchase, consumption, etc. Dispensers therefore often include a dispenser panel that is movable (e.g., slidable or hinged) with respect to the dispenser such that an opening within the dispenser can be closed for transport and yet opened for access to the articles when desired. However, due to the complexity of the at least some known dispenser panels, such dispensers are difficult and time-consuming to manufacture. Accordingly, such dispensers are costly to manufacture and require more human attention in the forming of the dispenser, as well as a more sophisticated forming machine, than many non-dispenser cases. Moreover, because of the increased costs, at least some dispenser cases are simply designed in an effort to reduce costs, manufacturing time, and labor, which oftentimes results in reduced functionality of the dispenser.

BRIEF DESCRIPTION OF THE INVENTION

In one aspect, the present invention includes a machine for forming a case from a blank of sheet material. The machine includes a body, a mandrel mounted on the body and having an external shape complimentary to an internal shape of at least a portion of the case, a member mounted on the body adjacent the mandrel for applying a force to the blank for at least one of folding a portion of the blank around the mandrel, moving the blank, and securing portions of the blank together, and a servomechanism operatively connected to the member for driving and controlling movement of the member to apply the force to the blank.

In another aspect, the present invention includes a machine for forming a case from a blank of sheet material. The machine includes a body, a mandrel mounted on the body and having an external shape complimentary to an internal shape of at least a portion of the case, and a member mounted on the body adjacent the mandrel for applying a force to the blank. The member includes an arm, and a tool extending from the arm. The tool includes a first extension, a second extension extending at an angle greater than zero with respect to the first extension, and a shape complimentary to an external shape of the case. The arm is rotatably mounted on the body for rotation with respect to the body and the mandrel for moving the tool into contact with the blank for applying a force to the blank.

In another aspect, a method is provided for forming a case from a blank of sheet material using a machine including a mandrel having an external shape complimentary to an internal shape of at least a portion of the case. The method includes aligning the blank against a portion of the mandrel, folding a first panel over the mandrel, and folding a second panel over the first panel and applying pressure to the second panel using a single tool mounted on the machine, wherein the same movement of the tool folds the second panel over the first panel and applies pressure to the second panel.

In another aspect, a method is provided for forming a case from a blank of sheet material using a machine including a mandrel having an external shape complimentary to an internal shape of at least a portion of the case and a member rotatably mounted on a body of the machine. The method includes aligning the blank against a portion of the mandrel, wrapping a portion of the blank around the mandrel, and applying a force to the blank on two intersecting faces of the mandrel by rotating the member with respect to the body.

In another aspect, the present invention includes a machine for forming a case from a blank of sheet material. The machine includes a body, and a mandrel mounted on the body. The mandrel includes a cross section having exactly seven exterior sides and being complimentary to an internal shape of at least a portion of the case. The machine also includes a member mounted on the body adjacent the mandrel for applying a force to the blank for at least one of folding a portion of the blank around the mandrel, moving the blank, and securing portions of the blank together.

DETAILED DESCRIPTION OF THE INVENTION

Figure 1:
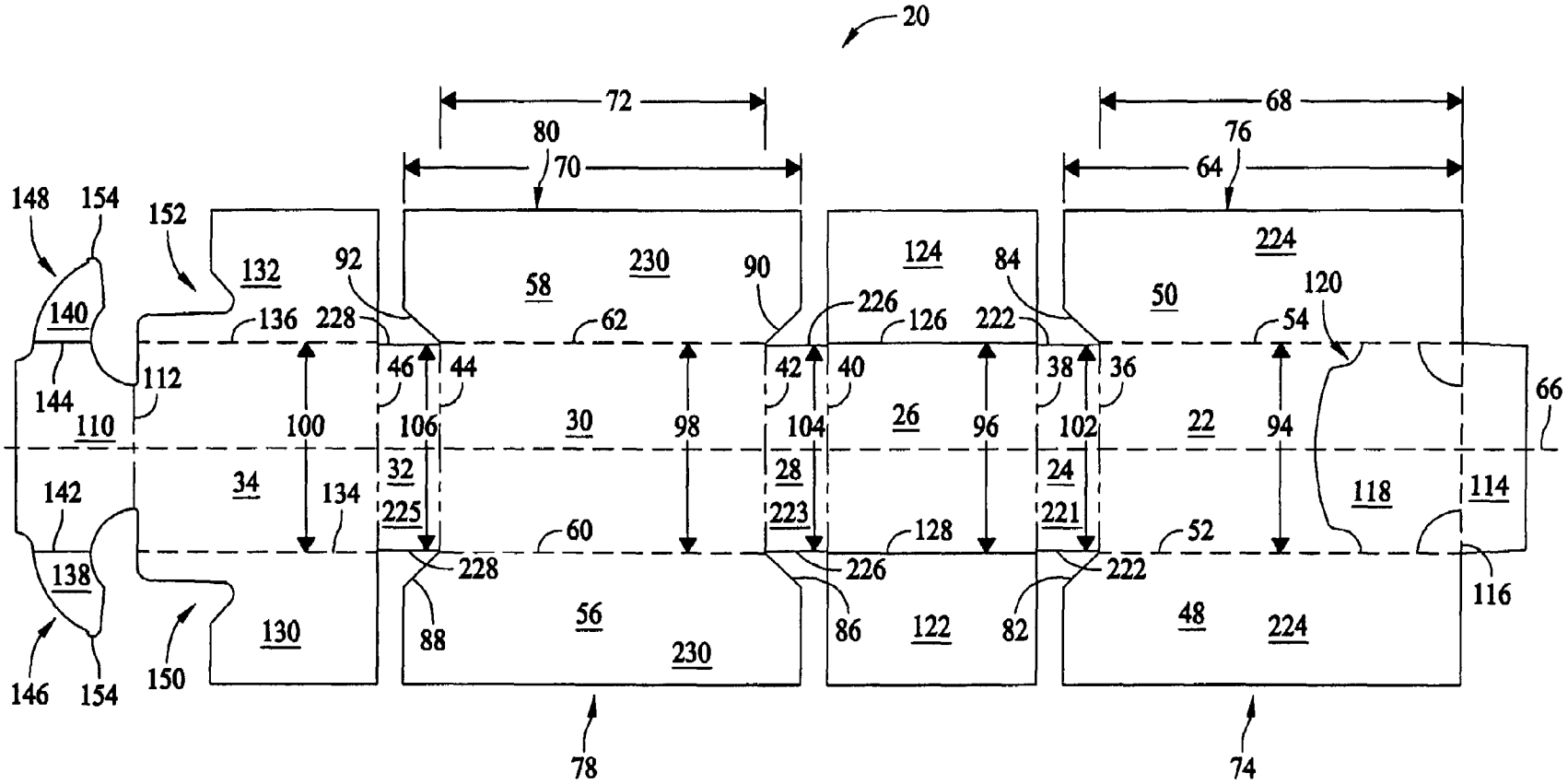
FIG. 1 is a top plan view of an exemplary embodiment of a flat blank of sheet material.

Referring now to the drawings, and more specifically to FIG. 1, a blank of sheet material for forming a dispenser case is designated in its entirety by the reference numeral 20. Although the blank may include any suitable material without departing from the scope of the present invention, in one embodiment the blank includes cardboard, corrugated board, and/or plastic.

The blank includes a succession of seven aligned rectangular panels 22, 24, 26, 28, 30, 32, 34 that are connected together by a plurality of preformed, generally parallel, fold lines 36, 38, 40, 42, 44, 46, respectively. Specifically, the seven aligned rectangular panels include a front panel 22, a top panel 26, a back panel 30, a bottom panel 34, and three intermediate panels 24, 28, 32. The intermediate panel 24 extends from the front panel 22 along the fold line 36, the top panel 26 extends from the intermediate panel 24 along the fold line 38, the intermediate panel 28 extends from the top panel 26 along the fold line 40, the back panel 30 extends from the intermediate panel 28 along the fold line 42, the intermediate panel 32 extends from the back panel 30 along the fold line 44, and the bottom panel 34 extends from the intermediate panel 32 along the fold line 46. Any of the intermediate panels 24, 28, 32 may be referred to herein as a first, a second, and/or a third intermediate panel.

The front panel 22 includes a pair of front flaps 48, 50 extending therefrom along a pair of opposite preformed fold lines 52, 54, respectively. Similarly, the back panel 30 includes a pair of black flaps 56, 58 extending therefrom along a pair of opposite preformed fold lines 60, 62, respectively. The fold lines 52, 54, 60, 62 are generally parallel to each other and generally perpendicular to the fold lines 36, 38, 40, 42, 44, 46. As shown in FIG. 1, each of the front flaps 48, 50 has a length 64 taken along a longitudinal axis 66 of the blank 20 that is greater than a length 68 of the front panel 22 also taken along the longitudinal axis. Similarly, each of the back flaps 56, 58 has a length 70 taken along the longitudinal axis 66 that is greater than a length 72 of the back panel 30 also taken along the longitudinal axis. Specifically, each of the front flaps 48, 50 includes an outer edge (generally designated by 74, 76, respectively) defining a perimeter of the flap. Similarly, each of the back flaps 56, 58 includes an outer edge (generally designated by 78, 80, respectively) defining a perimeter of the flap. The outer edges 74, 76 each include a respective portion 82, 84 that is obliquely angled with respect to respective fold lines 52, 54. Although other angles may be used without departing from the scope of the present invention, in one embodiment the portions 82, 84 are angled at about 45° with respect to the fold lines 52, 54, respectively. Similarly, the outer edge 78 of the back flap 56 includes a pair of opposite portions 86, 88 that are each obliquely angled with respect to the fold line 60, and the outer edge 80 of the back flap 58 includes a pair of opposite portions 90, 92 that are each obliquely angled with respect to the fold line 62. Although other angles may be used without departing from the scope of the present invention, in one embodiment the portions 86, 88 are angled at about 45° with respect to the fold line 60, and the portions 90, 92 are angled at about 45° with respect to the fold line 62.

Figure 3:
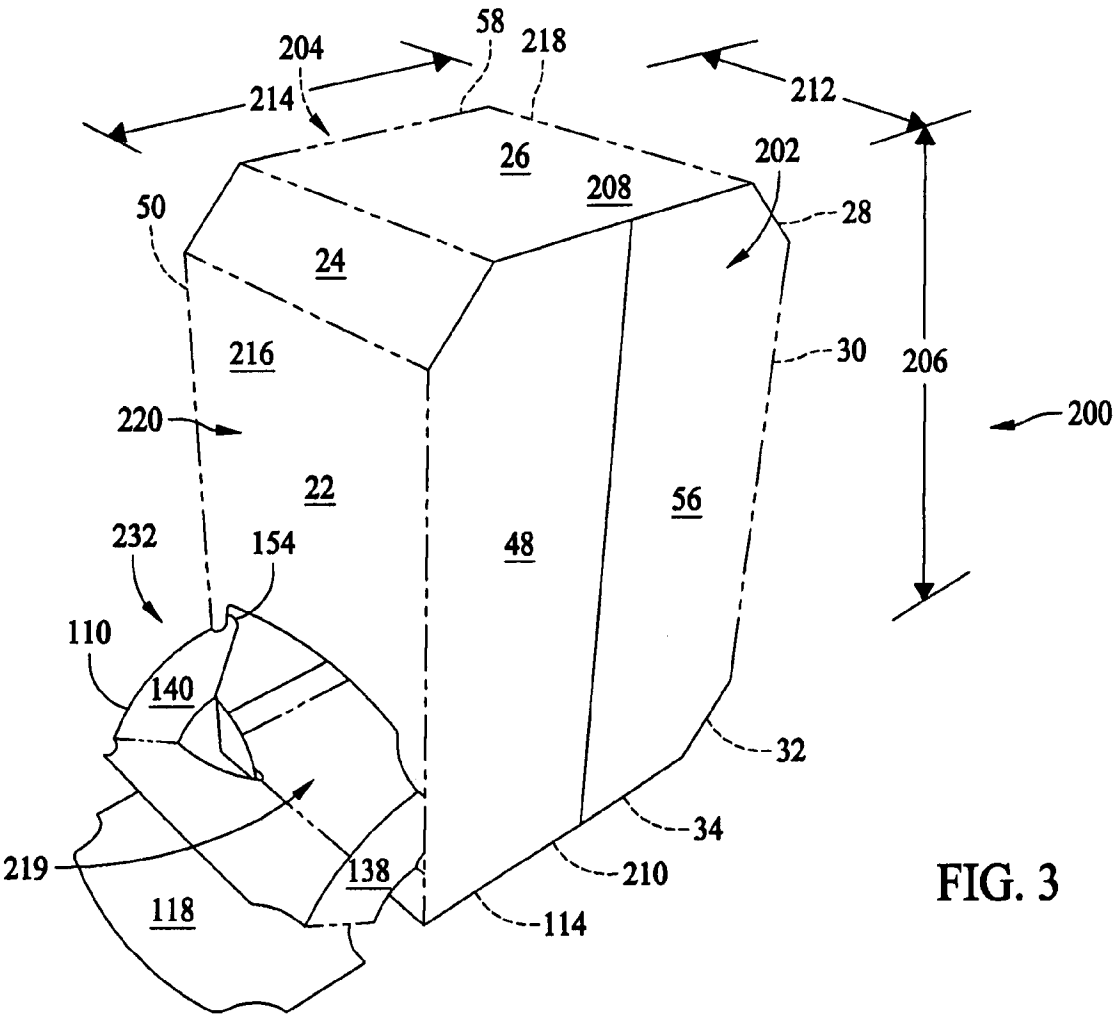
FIG. 3 is a perspective of an exemplary embodiment of a dispenser case that may be formed from the blank shown in FIG. 1.

As will be described in more detail below, the shape, size, and arrangement of the front flaps 48, 50 and the back flaps 56, 58 as shown in FIG. 1 and described above facilitates forming a case having angled corners, an example of which is shown in FIG. 3. More specifically, the shape, size, and arrangement of the front flaps 48, 50 and the back flaps 56, 58 facilitates forming a case having intermediate panels (e.g., the panels 24, 28, 32) that are obliquely angled with respect to, and interconnect, exterior panels (e.g., the front panel 22, the top panel 26, the back panel 30 and, the bottom panel 34) of the formed case.

Each of the front, top, back, and bottom panels 22, 26, 30, 34, respectively, has a respective width 94, 96, 98, 100. Although the front, top, back, and bottom panels 22, 26, 30, 34, respectively, may have different widths without departing from the scope of the present invention, in the embodiment shown in FIG. 1 (and additionally the exemplary case 200 embodied in FIG. 3), the widths 94, 96, 98, 100 are about equal. Additionally, each of the intermediate panels 24, 28, 32 has a respective width 102, 104, 106. Although the intermediate panels 24, 28, 32 may have different widths without departing from the scope of the present invention, in the embodiment shown in FIG. 1 (and additionally the exemplary case 200 embodied in FIG. 3) the widths 102, 104, 106 are about equal. Panels 24, 28, 32 may have any suitable size and/or shape. Although panels 24, 28, 32 are illustrate as being generally the same size and/or shape (e.g., width 102, 104, 106, respectively, and/or a length), any of panels 24, 28, 32 may include a different size and/or shape than other panels 24, 28, 32.

Figure 2:
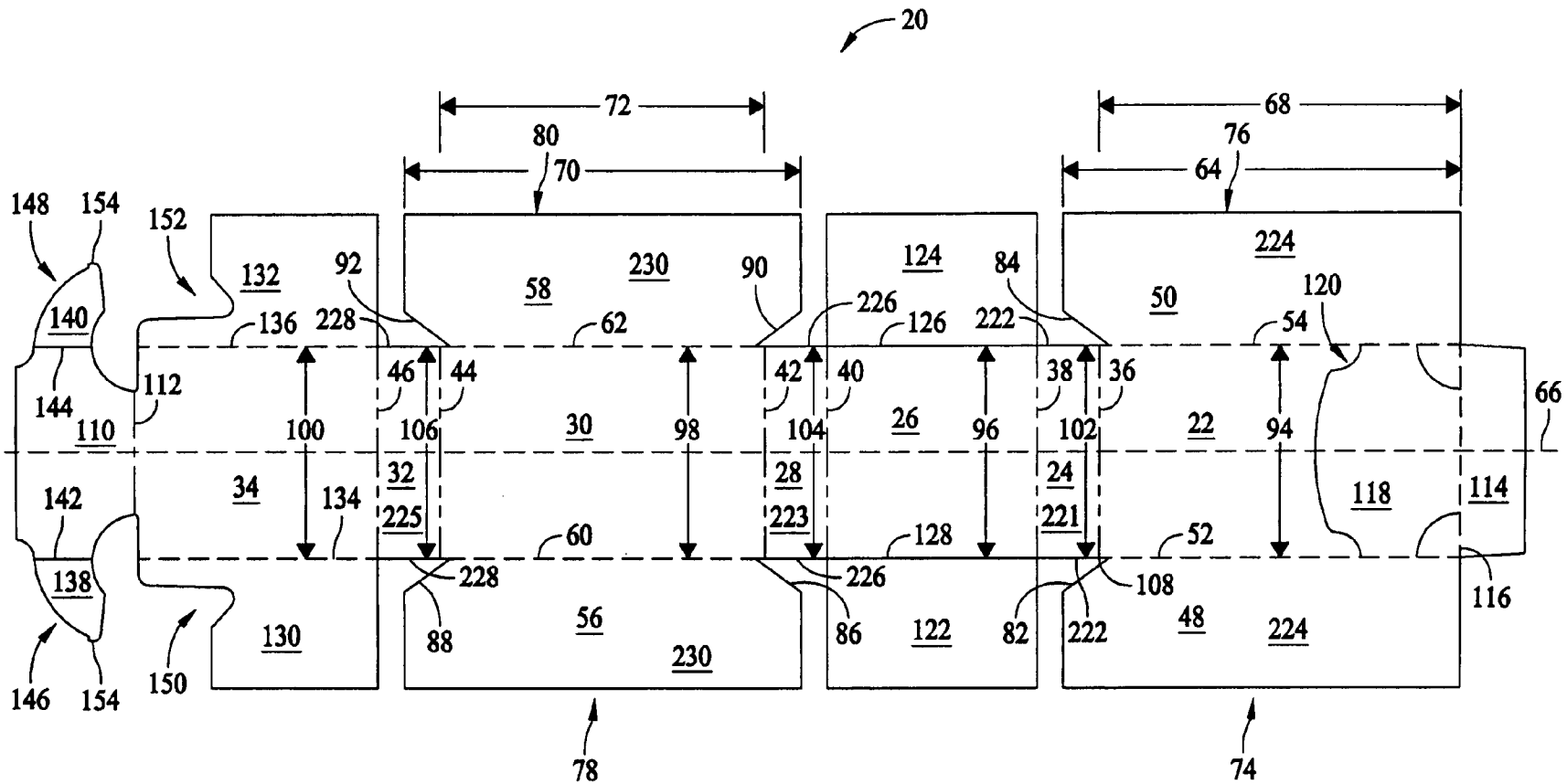
FIG. 2 is a top plan view of another exemplary embodiment of the flat blank of sheet material shown in FIG. 1.

As shown in FIG. 1, the widths 102, 104, 106 are less than the widths 94, 96, 98, 100 to accommodate a thickness of the flaps 48, 50, 56, 58, respectively, when the flaps are folded about the respective fold lines 52, 54, 60, 62 to form a case. As is described below, accommodating the thickness of the flaps 48, 50 56, 58 facilitates reducing gaps within an exterior of a formed case. Although the widths 102, 104, 106 may be less than the widths 94, 96, 98, 100 by any value without departing from the scope of the present invention, in one embodiment, the widths 102, 104, 106 are less than the widths 94, 96, 98, 100 by a value about equal to a thickness of the flaps 48, 50, 56, 68. Alternatively, as shown in FIG. 2, the widths 102, 104, 106 are generally equal to the widths 94, 96, 98, 100 and the edge portions 82, 84, 86, 90, 88, 92 are offset from their respective intermediate panels 24, 28, 32 along the longitudinal axis 66 to accommodate a thickness of the intermediate panels 24, 28, 32 when the flaps are folded to form a case, as will also be described in more detail below. More specifically, and with reference to only the front flap 48, the edge portion 82, and the intermediate panel 24 as an example, the edge portion 82 intersects the front panel 22 at a location offset along the longitudinal axis 66 from an intersection 108 between the front panel and the intermediate panel 24, and more specifically between the fold line 36 and the fold line 52.

Edge portions 84, 86, 88, 90, 92 are offset similarly to edge portion 82 in the alternative embodiment shown in FIG. 2 and therefore will not be described in more detail herein. Although edge portions 82, 84, 86, 88, 90, 92 may be offset along the longitudinal axis 66 by any distance without departing from the scope of the present invention, in one embodiment, the edge portions are offset by a distance about equal to a thickness of the intermediate panels 24, 28, 32. Of course, in another alternative embodiment (not shown) a combination of the embodiments shown in FIGS. 1 and 2 may be used to reduce gaps within an exterior of a formed case.

A dispenser panel 110 extends from the bottom panel 34 along a preformed fold line 112. Additionally, a cover flap 114 extends from the front panel 22 along a preformed fold line 116. The fold lines 112, 116 are generally parallel to the fold lines 36, 38, 40, 42, 44, 46. The front panel 22 includes a cover panel 118 at least partially defined by a frangible score line (generally designated by 120). Although the cover panel 118 may include any suitable shape without departing from the scope of the present, in one embodiment the cover panel includes a shape shown in FIG. 1. Specifically, in the embodiment shown in FIG. 1 the frangible score line 120 extends through the front panel between the fold lines 52, 54, extends partially along each of the fold lines 52, 54, and extends partially along the fold line 116. The frangible score line 120 allows the cover panel 56 to be at least partially detached from a case formed from the blank 20, as will be described in more detail below. For example, in the embodiment illustrated in FIG. 1, the cover panel 118 may be detached from the front panel 22 to facilitate providing an opening (not shown in FIG. 1) in a dispenser case formed from the blank 20 for dispensing articles contained within the case. Additionally, as shown in FIG. 1 and will be described in more detail below, in one embodiment the dispenser panel 110 includes a shape that is complimentarily shaped with respect to a shape of the cover panel 118, and more specifically an opening (not shown in FIG. 1) provided within the front panel when the cover panel has been at least partially detached from the front panel.

The top panel 26 includes a pair of top flaps 122, 124 extending therefrom along a pair of opposite preformed fold lines 126, 128, respectively. Similarly, the bottom panel 34 includes a pair of bottom flaps 130, 132 extending therefrom along a pair of opposite preformed fold lines 134, 136, respectively, and the dispenser panel 110 includes a pair of dispenser flaps 138, 140 extending therefrom along a pair of opposite preformed fold lines 142, 144. The fold lines 126, 128, 134, 136, 142, 144 are generally parallel to each other and the fold lines 52, 54, 60, 62, and are generally perpendicular to the fold lines 36, 38, 40, 42, 44, 46, 112, 116. In one embodiment each of the dispenser flaps 138, 140 includes a portion (generally designated by 146, 148, respectively) that is complimentarily shaped to a portion (generally designated by 150, 152, and sometimes referred to herein as a slot) of the respective bottom flap 130, 132. The complimentarily shaped portions 146, 148, 150, 152 facilitate movement of the dispenser flaps 138, 140 along a respective side (not shown in FIGS. 1 and 2) of a dispenser case formed from the blank 20. More specifically, flap portions 146, 148 are each at least partially received within slots 150, 152, respectively.

In one embodiment, at least one of the dispenser flaps 138, 140 includes an extension 154. The extension(s) 154 engages a portion of the front panel 22 of a case formed from the blank 20 to control movement of the dispenser panel 110 with respect to other portions of the formed case, as will be described in more detail below.

As will be described below in more detail with reference to FIGS. 4-22, the blank 20 is intended to form a dispensing case as shown in FIG. 3 (designated in its entirety by 200) by wrapping and/or fastening the panels 22, 24, 26, 28, 30, 32, 34, 110, 114 and the flaps 122, 124, 130, 132 (shown in FIGS. 1 and 2), 48, 50, 56, 58, 138, 140. Of course, blanks having shapes, sizes, and configurations different than the blank 20 described and illustrated herein may be used to form the dispensing case 200 shown in FIG. 3 without departing from the scope of the present invention.

The front panel 22, the top panel 26, the back panel 30, and the bottom panel 34 form exterior front, top, back, and bottom panels, respectively, of the case 200. The intermediate panel 24 connects the front panel 22 to the top panel 26, the intermediate panel 28 connects the top panel to the back panel 30, and the intermediate panel 32 connects the back panel to the bottom panel 34. The case 200 also includes a pair of opposite exterior sides (generally designated by 202, 204) which are formed from the front flaps 48, 50 and the back flaps 56, 58. More specifically, the front flaps 48, 50 are each orientated generally perpendicular to the front panel 22 such that each of the front flaps form a portion of a respective side of the exterior sides 202, 204. Similarly, the back flaps 56, 58 are each orientated generally perpendicular to the back panel 30 such that each of the back flaps 56, 58 form a portion of a respective side of the exterior sides 202, 204. Accordingly, the case 200 has a height 206 measured between an exterior surface 208 of the top panel 26 and an exterior surface 210 of the bottom panel 34 that is about equal to the length 64 (shown in FIGS. 1 and 2) of the front flaps 48, 50 and the length 70 (shown in FIGS. 1 and 2) of the back flaps 56, 58. Either of the sides 202, 204 of the case 200 may be referred to herein as a first and/or a second side.

The case has a width 212 measured between the exterior sides 202, 204, and a depth 214 measured between an exterior surface 216 of the front panel 22 and an exterior surface 218 of the back panel 30. The width 212 is substantially equal to the widths 94, 96, 98, 100 of the front, top, back, and bottom panels 22, 26, 30, 34, respectively. Although the case 200 may have other orientations without departing from the scope of the present invention, in the embodiment shown in FIG. 3 the top and bottom panels 26, 30 are generally parallel with each other, and the front and back panels 22, 34 are generally parallel with each other. Moreover, the front and back panels 22, 34 are generally perpendicular to the top and bottom panels 26, 30. The intermediate panels 24, 28, 32 each form the angled corners of the case 200. Specifically, the intermediate panels 24, 28, 32 are obliquely angled with respect to the panels they interconnect. More specifically, the intermediate panel 24 is obliquely angled with respect to the front panel 22 and the top panel 26, the intermediate panel 28 is obliquely angled with respect to the top panel 26 and the back panel 30, and the intermediate panel 32 is obliquely angled with respect to the back panel 30 and the bottom panel 34. Although other angles may be used without departing from the scope of the present invention, in the embodiments illustrated herein, because each of the portions 86, 88 (shown in FIGS. 1 and 2) are angled at about 45° with respect to the fold line 60, and additionally each of the portions 90, 92 (shown in FIGS. 1 and 2) are angled at about 45° with respect to the fold line 62, each of the intermediate panels 24, 28, 32 are angled at about 135° with respect to each of the panels they interconnect (22, 26, 30, 34, respectively). The oblique angle of the intermediate panel 32 with respect to the bottom and back panels 34, 30, respectively, may facilitate dispensing articles from the case 200. Specifically, the intermediate panel 32 may guide articles contained within the case 200 generally toward an opening (generally designated by 219) provided by hinging the cover panel 118 and the dispenser panel 110 away from the front panel 22, as will be described below. Of course, any of the intermediate panels 24, 28, 32 may be sized differently than illustrated herein with respect to each other and/or the front, top, back, and bottom panels 22, 26, 30, 24, respectively. For example, in one embodiment, the intermediate panel 24 is sized smaller than the intermediate panels 28, 32 to allow for more space on front panel 22 for branding/marketing graphics and/or text.

As briefly discussed above, the front, top, back, and bottom panels 22, 26, 30, 34, respectively, each form a portion of an exterior (generally designated by 220) of the case 200. Additionally, in the embodiment shown in FIG. 3 the intermediate panels 24, 28, 32 also each form a portion of the exterior 220. However, any of the intermediate panels 24, 28, 32 may be interior panels of the case 200 without departing from the scope of the present invention.

The top flaps 122, 124 (shown in FIGS. 1 and 2) are each orientated generally perpendicular to the top panel 26 and are folded beneath the front and back flaps 48, 50, 56, 58, respectively. Similarly, the bottom flaps 130, 132 (shown in FIGS. 1 and 2) are each orientated generally perpendicular to the bottom panel 34 and are folded beneath the front and back flaps 48, 50, 56, 58, respectively. Although the case 200 may be secured together using any suitable fastener at any suitable location on the case without departing from the scope of the present invention, in one embodiment adhesive is applied to outer surfaces (not shown) of the top and bottom flaps 122, 124, 130, 132, respectively, to secure the exterior sides 202, 204 of the case. As discussed above, to facilitate reducing gaps in the case 200 and to generally accommodate interconnection of the front and back flaps 48, 50, 56, 58 with the intermediate panels 24, 28, 32, the widths 102, 104, 106 (shown in FIGS. 1 and 2) of the intermediate panels may be less than the widths 94, 96, 98, 100 (shown in FIGS. 1 and 2) of the front, top, back, and bottom panels 22, 26, 30, 32 to accommodate a thickness of the flaps 48, 50, 56, 58. Accordingly, outer edges (shown in FIGS. 1 and 2 and designated by 222) of the intermediate panel 24 rest against interior surfaces (shown in FIGS. 1 and 2 and designated by 224) of each of the front flaps 48, 50. Similarly, outer edges (shown in FIGS. 1 and 2 and designated by 226) of the intermediate panel 28 and outer edges (shown in FIGS. 1 and 2 and designated by 228) of the intermediate panel 32 rest against interior surfaces (shown in FIGS. 1 and 2 and designated by 230) of each of the back flaps 56, 58. In one embodiment, adhesive may be applied to the outer edges 222, 226, 228 and/or the interior surfaces 224, 230 to secure the intermediate panels 24, 28, 32 to the front and back flaps 48, 50, 56, 58.

As discussed above, in the alternative embodiment shown in FIG. 2 the edge portions 82, 84, 86, 90, 88, 92 are offset from their respective intermediate panels 24, 28, 32 to accommodate a thickness of the intermediate panels 24, 28, 32. Accordingly the edge portions 82, 84 will rest against an interior surface 221 of the intermediate panel 24, the edge portions 86, 90 will rest against an interior surface 223 of the intermediate panel 28, and the edge portions 88, 92 will rest against an interior surface 225 of the intermediate panel 32.

Referring again to FIG. 3, the case 200 includes a dispenser portion (generally designated by 232) for dispensing multiple individual articles, such as confectionary products (e.g., candy, gum, etc.), bulk products, food condiments (e.g., packets of sugar, salt, ketchup, mustard, etc.), or other dispensable articles contained by the case. The dispenser portion 232 includes, among other things, the cover panel 118 and the dispenser panel 110. When the case 200 is formed, the dispenser panel 110 is oriented generally perpendicular to the bottom panel 34 and the dispenser flaps 138, 140 are oriented generally perpendicular to the dispenser flap. The front panel 22, including the cover panel 118, is parallel to and covers the dispenser panel 110. The cover flap 114 is secured to a portion of the bottom panel 34. Although the cover flap 114 may be secured to the bottom panel 34 using any suitable faster, in one embodiment the cover flap is secured to the bottom panel using an adhesive.

The opening 219 can be provided to dispense articles contained by the case 200. For example, portions of the frangible score line 120 connecting the cover panel 118 to the front flaps 48, 50 and the front panel 22 can be broken so the cover panel can be partially removed by rotating generally away from the front panel about the portion of the frangible score line connecting the cover panel to the cover flap 114. The cover panel 118 can also be completely removed by breaking the portion of the frangible score line 120 connecting the cover panel 118 to the cover flap 114. In the embodiments illustrated herein, the dispenser panel 110 includes a shape that generally corresponds to a shape of the cover panel 118. However, the dispenser panel 110 may include different shapes from the cover panel 118 without departing from the scope of the present invention. The dispenser panel 110 is hingedly connected to the bottom panel 34 along the fold line 112 and can be rotated away from the front panel 22 about the fold line 112 to provide the opening 219. Specifically, the dispensing panel 110 includes a closed position (not shown) wherein the opening 219 is generally closed and an open position shown in FIG. 3 wherein the opening 219 is generally open and articles can be removed from the case 200.

The dispenser flaps 138, 140 extend through the opening 219 into an interior space of the case 200. The flaps 138, 140 generally support the dispenser panel 110, guide and control movement of the dispenser panel, and facilitate containing articles that are resting, directly or indirectly, on the dispenser panel. For example, as discussed above at least one of the dispensing flaps 138, 140 may include the extension 154 that engages a portion of the front panel 22. The extensions 154 acts as a stop to limit further rotation of the dispenser panel 110 about the fold line 112 and away from the front panel 22. Although other angles may be used without departing from the scope of the present invention, in one embodiment the extension 154 stop the dispenser panel from rotating past an angle of between about 30° and about 70° with respect to the front panel 22. As also discussed above, portions 146, 148 of the dispenser flaps 138, 140 may be complimentarily shaped to portions 150, 152 of the respective bottom flap 130, 132. The complimentarily shaped portions 146, 148, 150, 152 facilitate movement of the dispenser flaps 138, 140 along an interior surface (not shown) of the respective side 202, 204.

Figure 4:
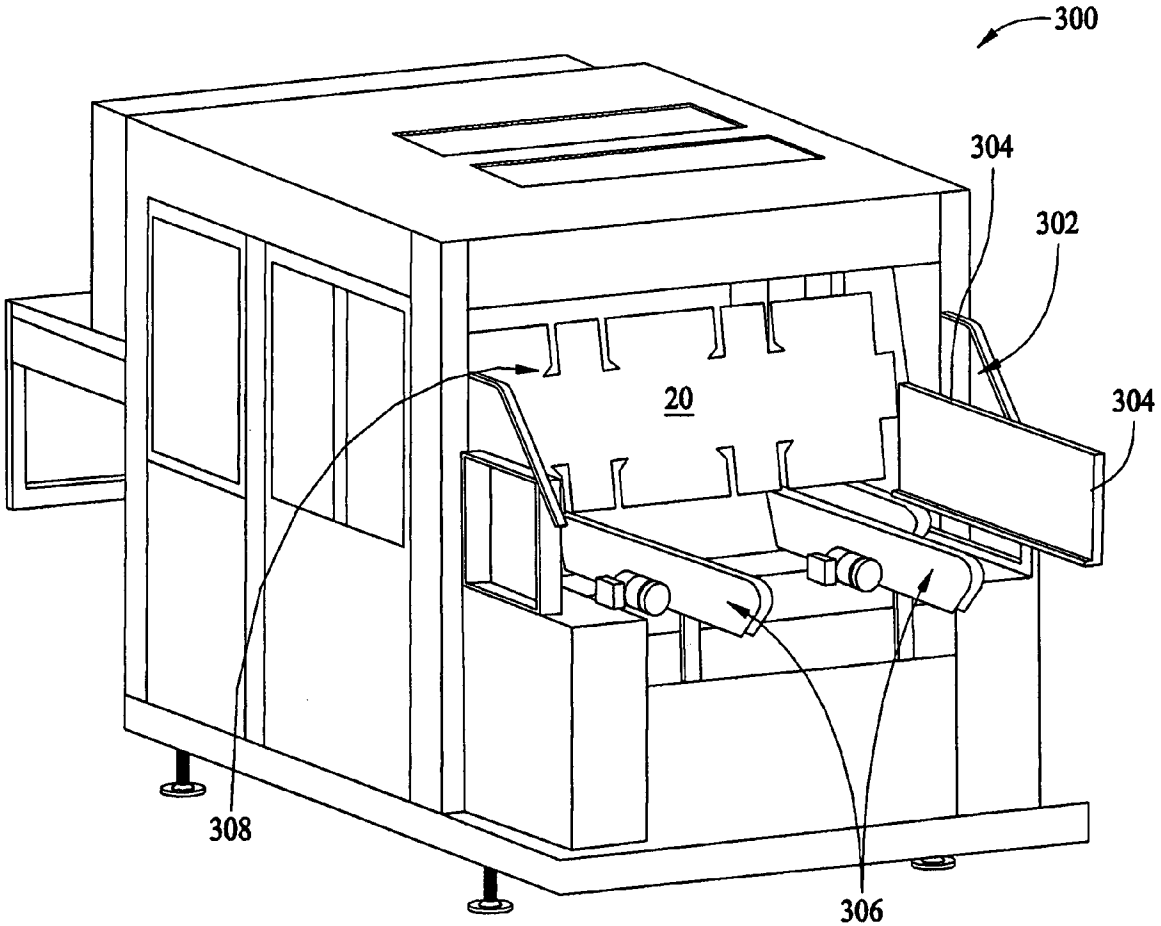
FIG. 4 is a perspective of an exemplary embodiment of a machine that may be used to form a case from the blank of sheet material shown in FIG. 1 or 2.

FIG. 4 illustrates a machine (generally designated by 300) for forming a case (e.g., the dispenser case 200 shown in FIG. 3) from a blank of sheet material (e.g., the blank 20 shown in FIG. 1 or 2). The machine 300 will be discussed hereafter with reference to forming the dispenser case 200 from the blank 20. However, the machine 300 may be used to form a case having any size, shape, or configuration from a blank having any size, shape, or configuration without departing from the scope of the present invention.

Figure 5:
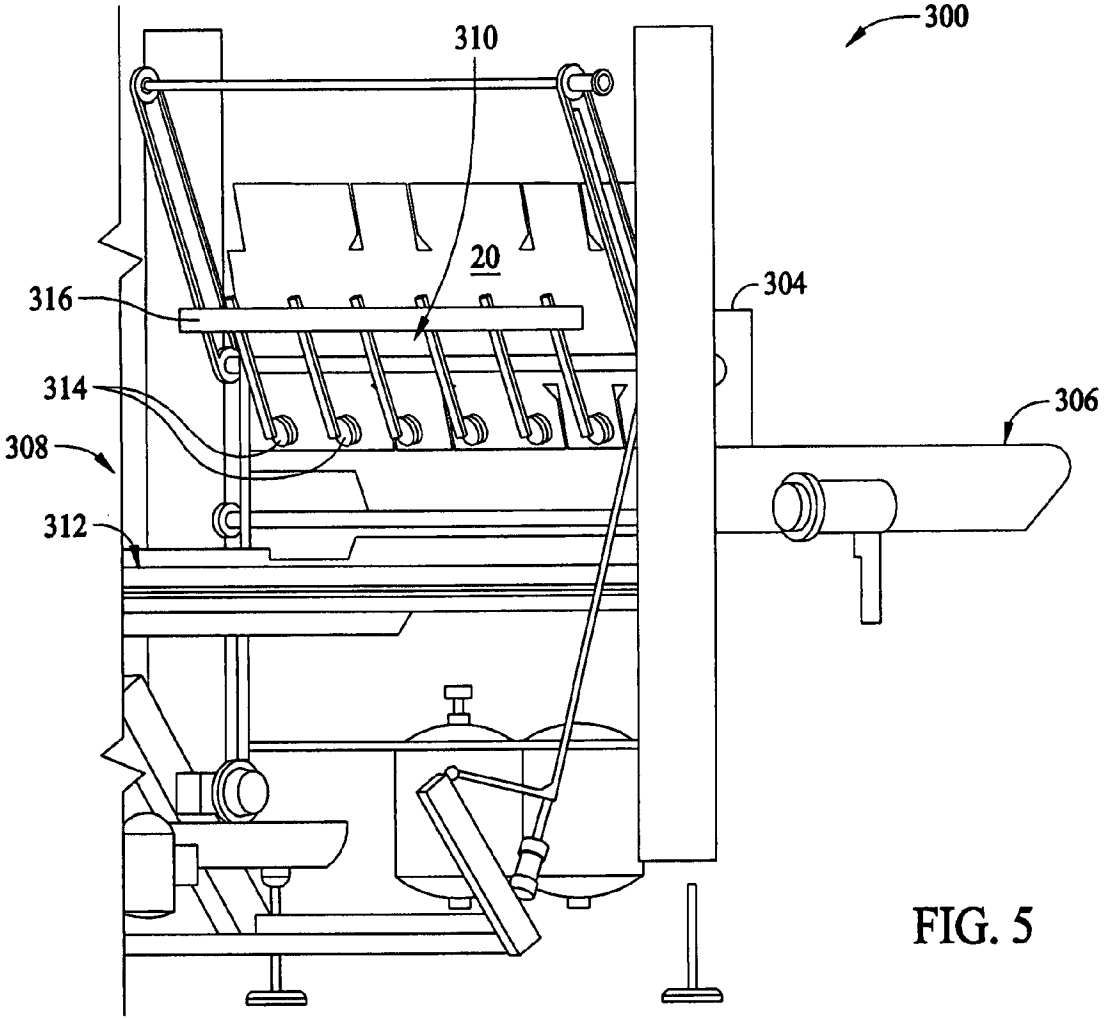
FIG. 5 is a perspective of a portion of the machine shown in FIG. 4.
Figure 6:
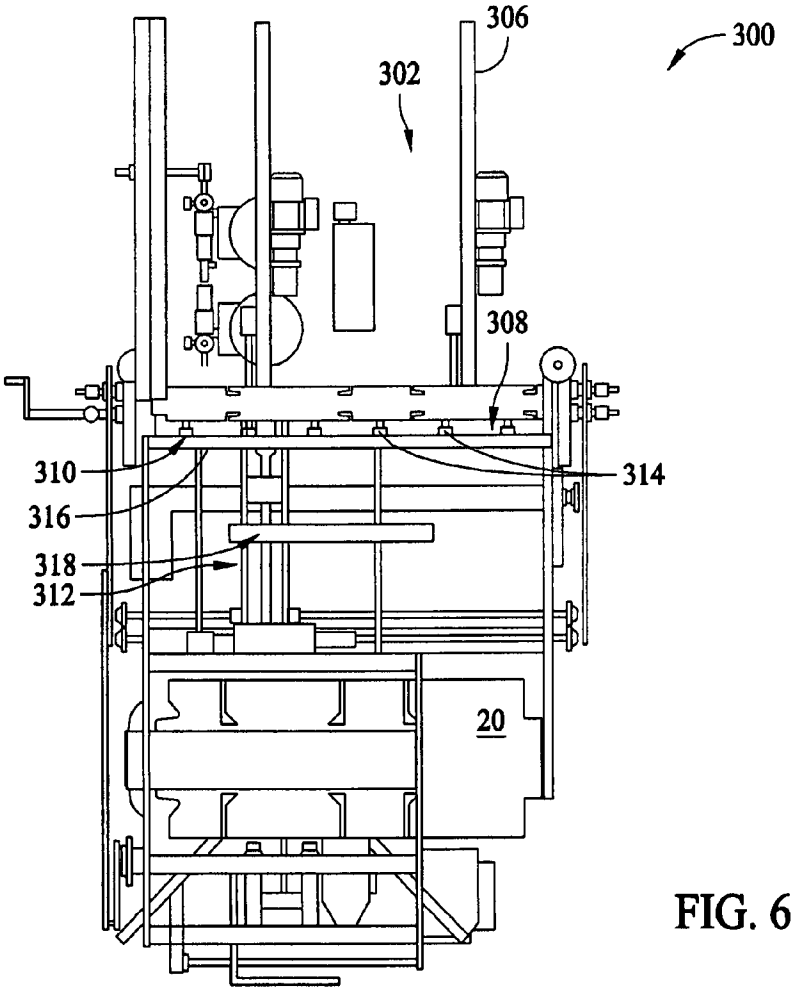
FIG. 6 is a top plan view of the machine shown in FIG. 4.

The machine 300 includes a loading section (generally designated by 302) for loading blanks into the machine for formation into cases. Specifically, a blank 20 is loaded into a loading frame 304 that supports the blank in a generally vertical position. A conveyor 306 moves the blank 20 into a transfer section (generally designated by 308) as the loading frame 304 supports the blank. As shown in FIGS. 5 and 6, a gripping member (generally designated by 310) attaches to the blank 20 and lifts the blank out of the loading frame 304 and places the blank onto a support (generally designated by 312) in a generally horizontal position. Although any suitable gripping mechanism, structure, and/or means may be used to attach to the blank 20 and lift the blank out of the loading frame 304 and onto the support 312 without departing from the scope of the present invention, in one embodiment the gripping member 310 includes a plurality of vacuum cups 314 connected to a rotating frame 316. The vacuum cups 314 attach to the blank 20 and grip the blank as the rotating frame 316 positions the blank over the support 312 in front of a pusher assembly (shown in FIG. 6 and generally designated by 318). The vacuum cups 312 then release their grip to place the blank onto the support 312.

Figure 7:
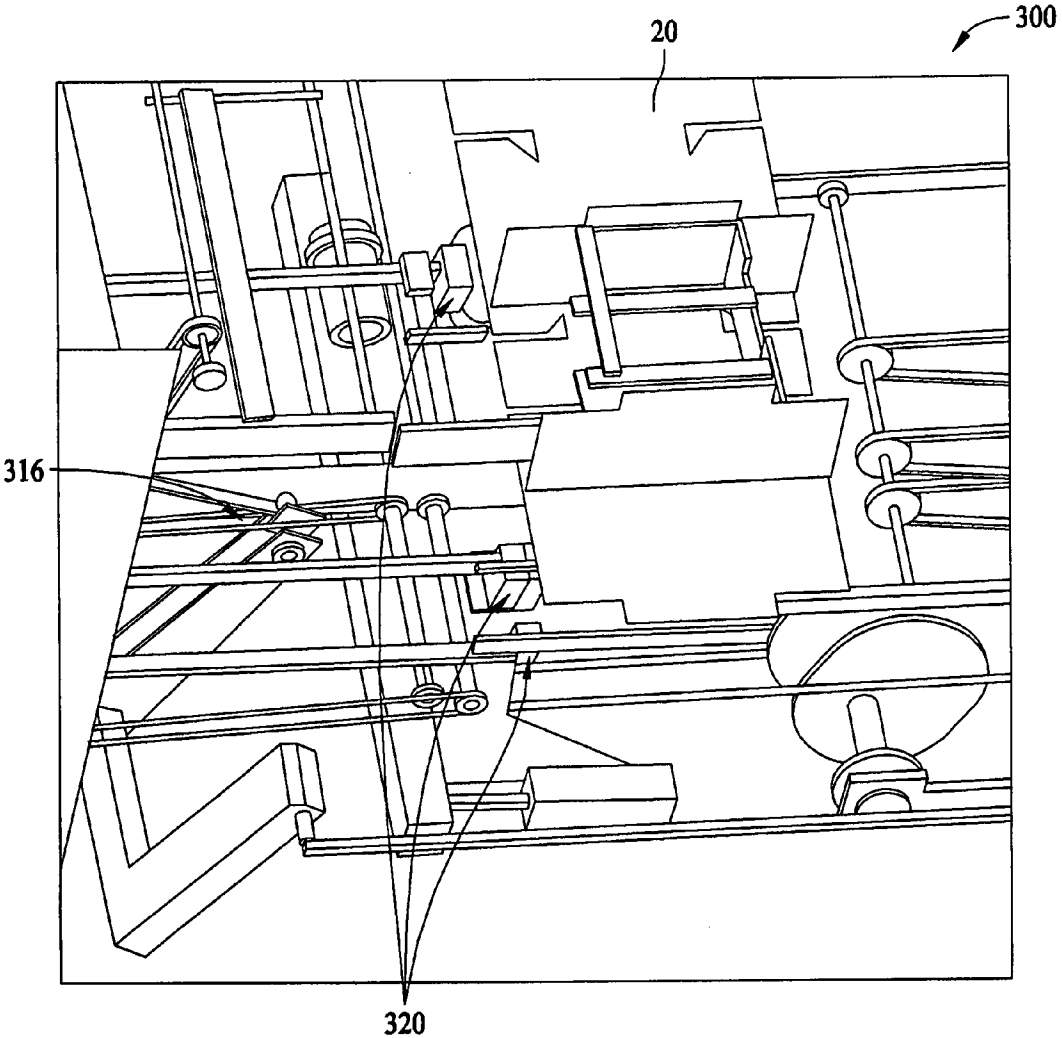
FIG. 7 is a perspective of a portion of the machine shown in FIG. 4.
Figure 8:
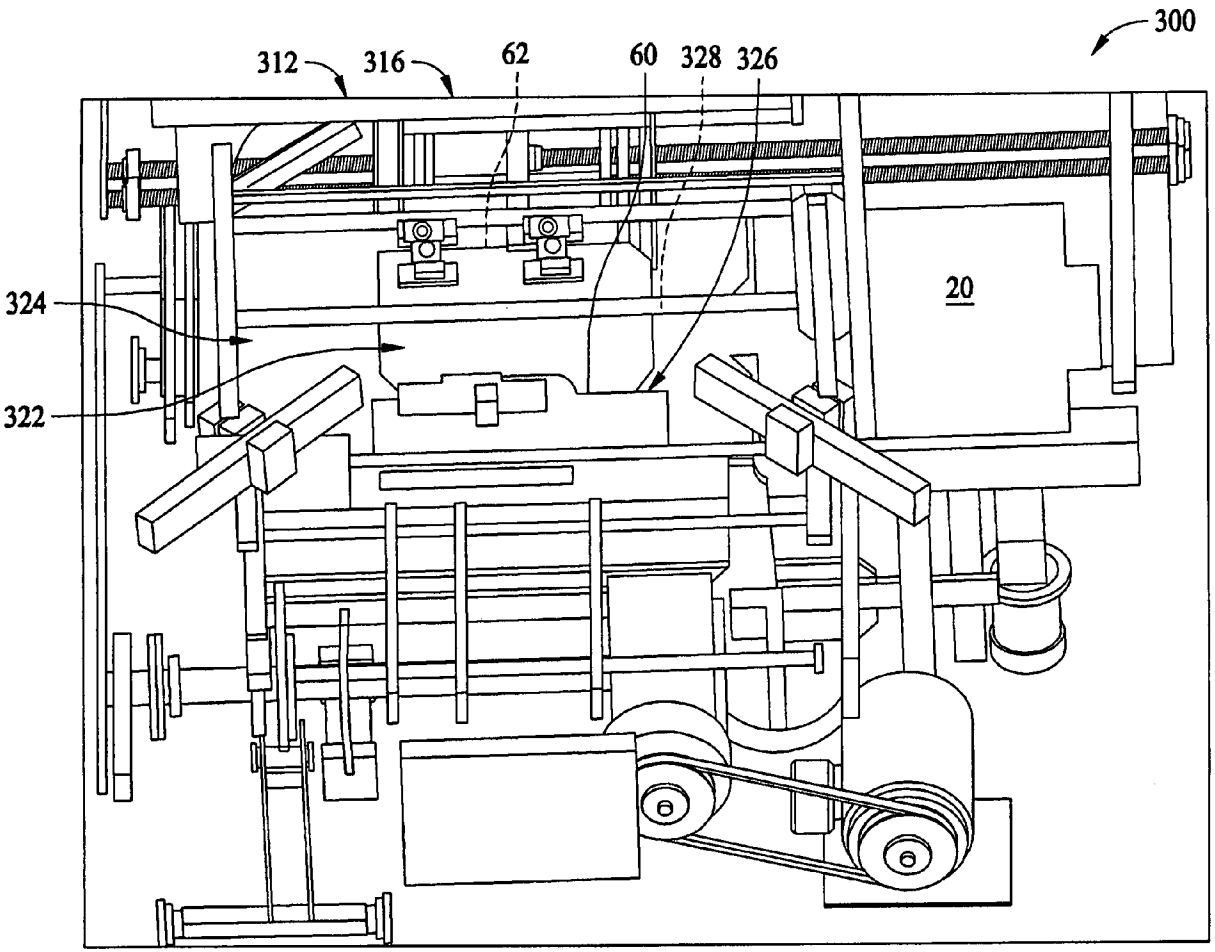
FIG. 8 is another perspective of a portion of the machine shown in FIG. 4.
Figure 9:
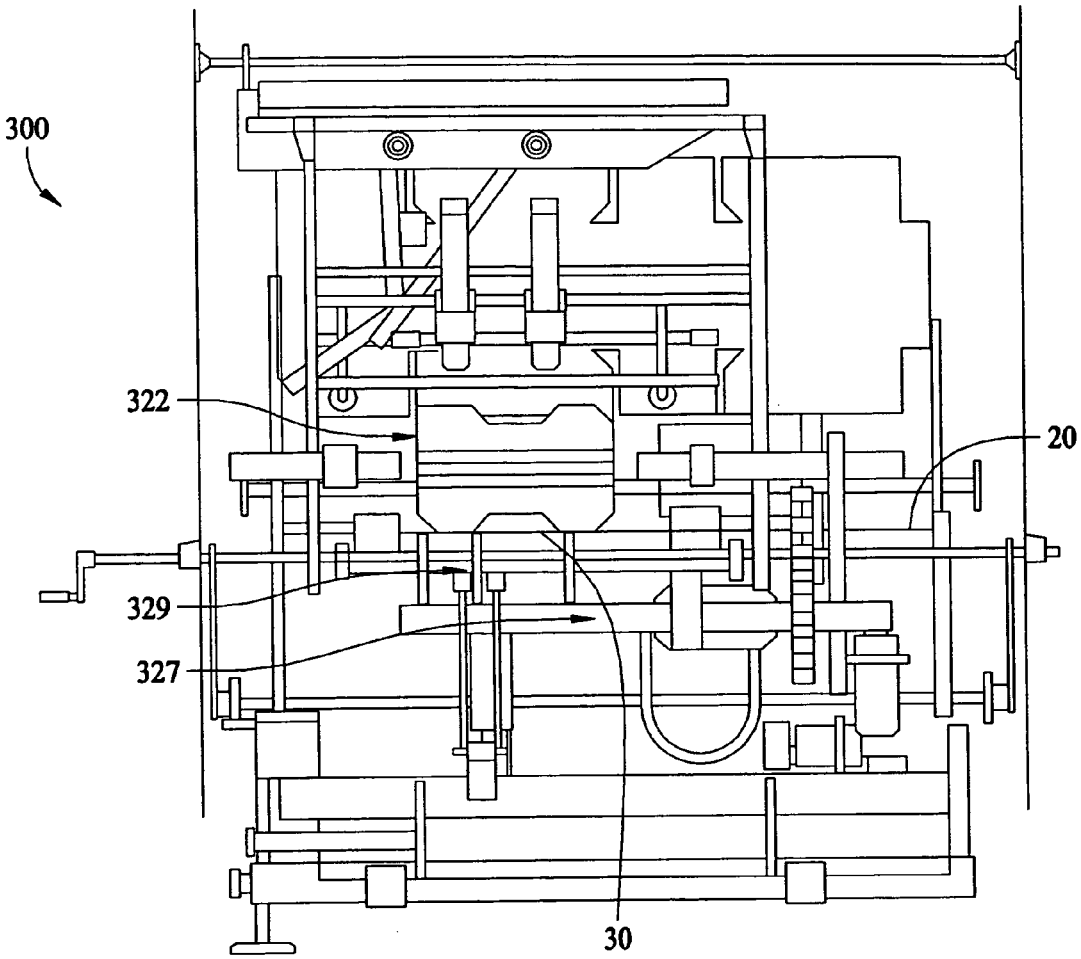
FIG. 9 is a front elevation of the machine shown in FIG. 4.
Figure 10:
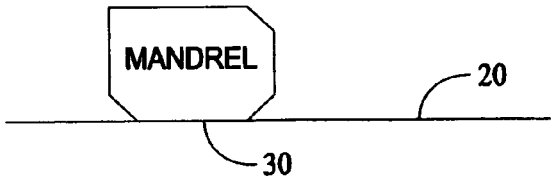
FIG. 10 is a cross section of an exemplary embodiment of a mandrel of the machine shown in FIG. 4 illustrating the blank shown in FIG. 1 or 2 wrapped partially therearound.
Figure 11:
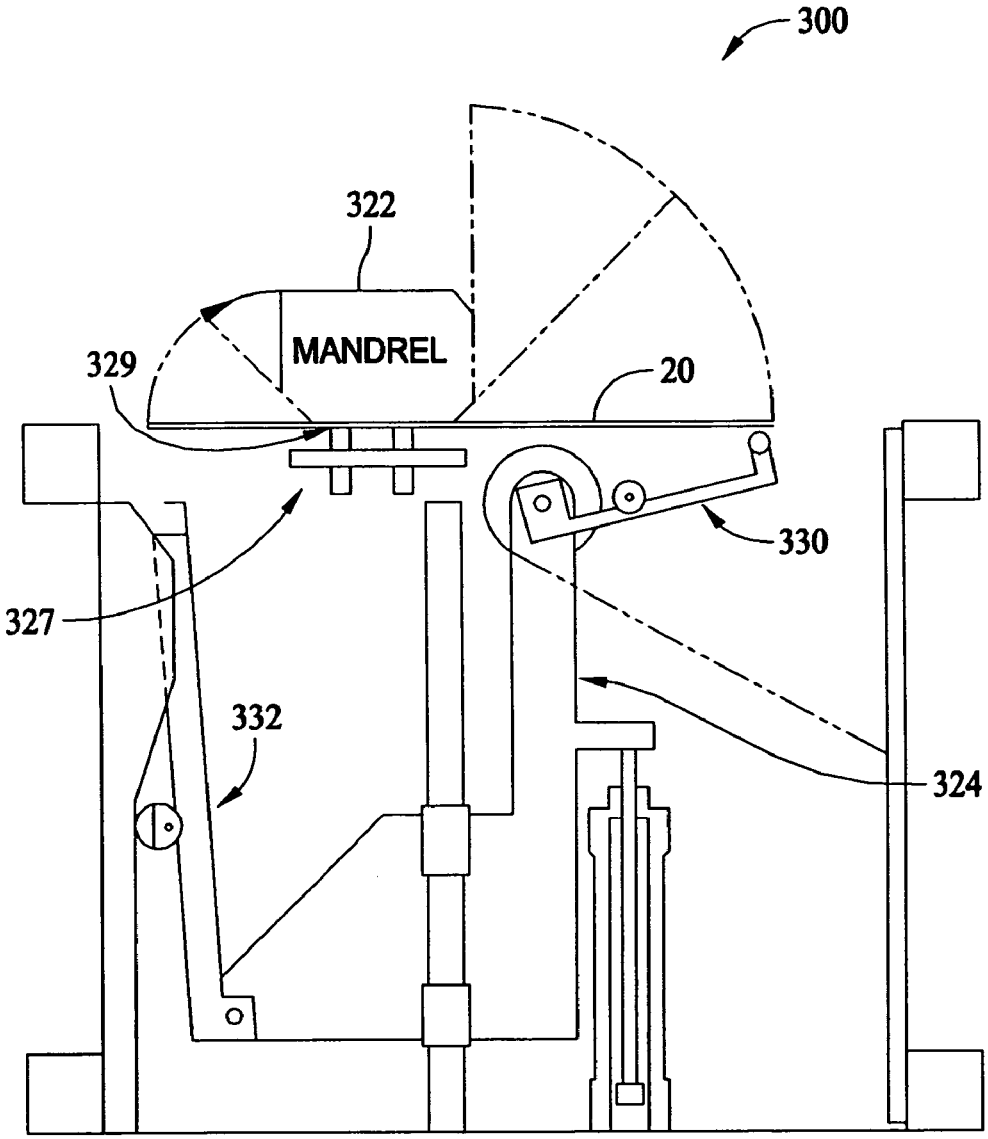
FIG. 11 is a schematic of a portion of the machine shown in FIG. 4.
Figure 12:
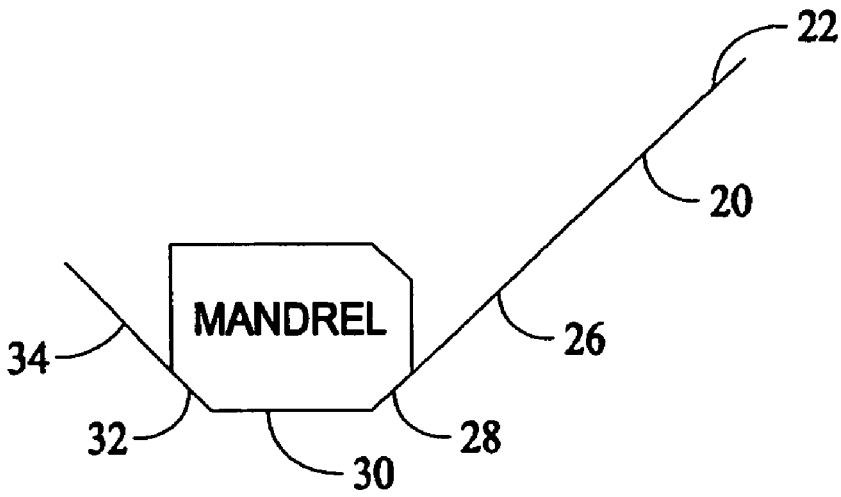
FIG. 12 is a cross section of the mandrel of the machine shown in FIG. 4 illustrating the blank shown in FIG. 1 or 2 wrapped partially therearound.
Figure 13:
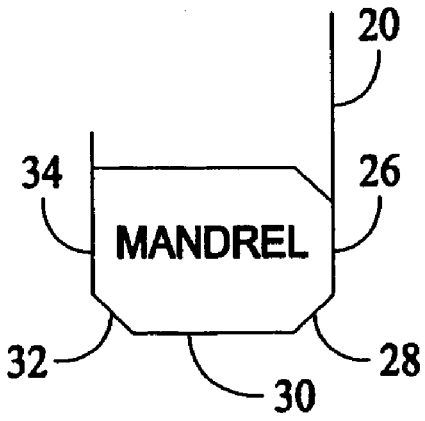
FIG. 13 is a cross section of the mandrel of the machine shown in FIG. 4 illustrating the blank shown in FIG. 1 or 2 wrapped partially therearound.

As shown in FIG. 7, the pusher assembly 316 pushes the blank 20 over three hot melt glue guns 320 where adhesive is applied to surfaces (not shown) of the top flap 122 and the bottom flap 130, as well as a surface (not shown) of the bottom panel 34 that the cover flap 114 attaches to. As shown in FIG. 8, the pusher assembly 316 guides the blank 20 along the support 312 until the blank is underneath a mandrel (generally designated by 322) mounted on a body (generally designated by 324) of the machine 300. The mandrel 322 has an external shape that is complimentary to at least a portion of an internal shape of the dispenser case 200 formed from the blank 20. The pusher assembly 316 pushes the blank 20 along the support 312 such that the back panel 30 is positioned underneath the mandrel 322 and the fold lines 60, 62 are aligned with respective outer edges 326, 328 of the mandrel. As shown in FIG. 9, a lifting assembly (generally designated by 327) lifts the blank 20 off the support 312 (shown in FIGS. 5-8) and pushes the back panel 30 tight against the mandrel 322. More specifically, a member (generally designated by 329 and sometimes referred to as a pressure plate) of the lifting assembly 327 engages the back panel 30 and pushes the back panel tight against the mandrel 322. FIG. 10 generally illustrates the position of the blank 20 with respect to the mandrel 322 after the member 329 engages the back panel 30. As shown in FIGS. 11-13, a member 330 of machine 300 engages at least one of the top panel 26 and the front panel 22 and wraps the intermediate panel 28 and the top panel 26 around the mandrel. Although any suitably configured member may be used to wrap the intermediate panel 28 and the top panel 26 around the mandrel 322 without departing from the scope of the present invention, in the exemplary embodiment the member 330 is an arm rotatably mounted to machine body 324. Additionally, a member (generally designated by 332) engages the bottom panel 34 and wraps the intermediate panel 32 and the bottom panel 34 around the mandrel 322. FIGS. 12 and 13 generally illustrate the blank 20 as wrapped around the mandrel 322 by the by members 329, 330, 332.

Figure 14:
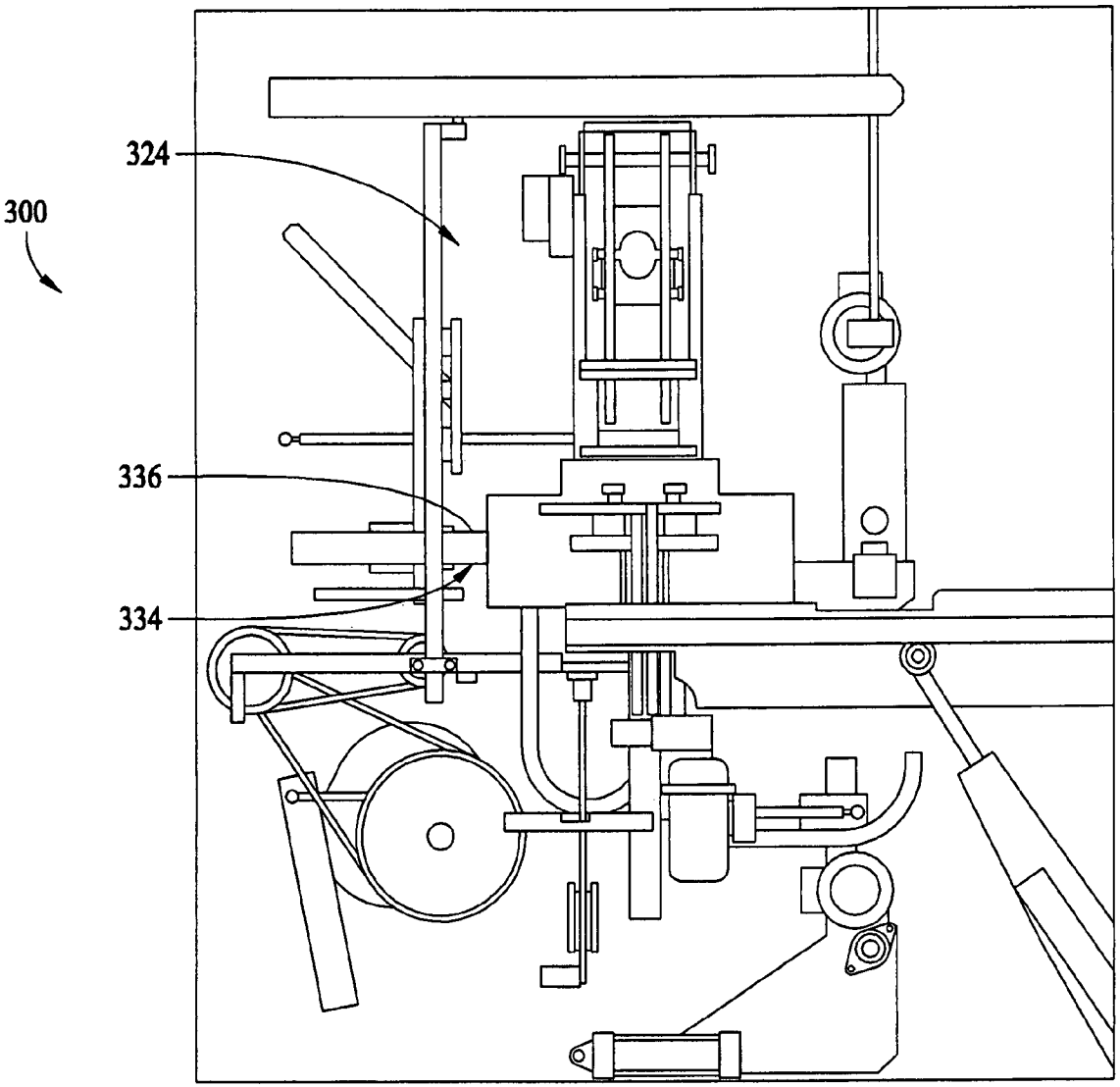
FIG. 14 is a side elevation of a portion of the machine shown in FIG. 4.

As shown in FIG. 14, a flap folder member (generally designated by 334) folds the top flap 122 and the bottom flap 130 tight against the mandrel 322. More specifically, the flap folder member 334 is movably mounted to the body 324 and an end 336 of the flap folder engages the top flap 122 and the bottom flap 130 and folds the top flap along the fold line 126 and the bottom flap along the fold line 134 until the top and bottom flaps are tight against the mandrel 322.

Figure 15:
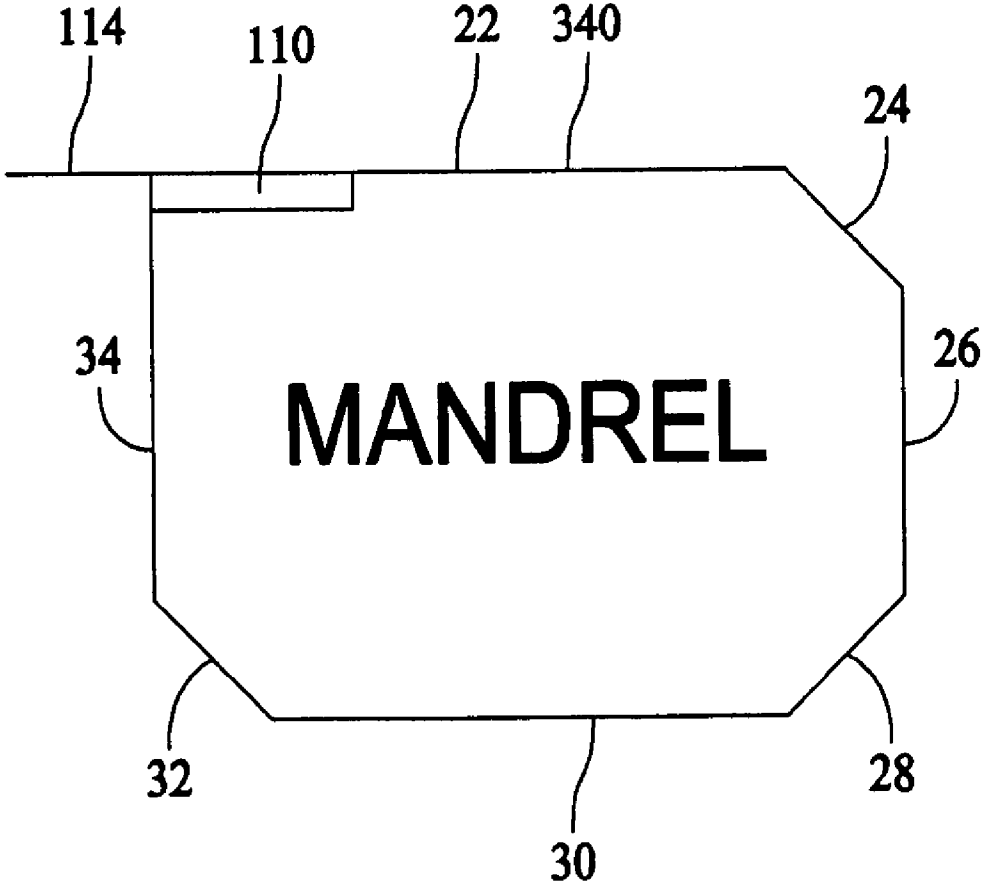
FIG. 15 is a cross section of the mandrel of the machine shown in FIG. 4 illustrating the blank shown in FIG. 1 or 2 wrapped partially therearound.
Figure 16:
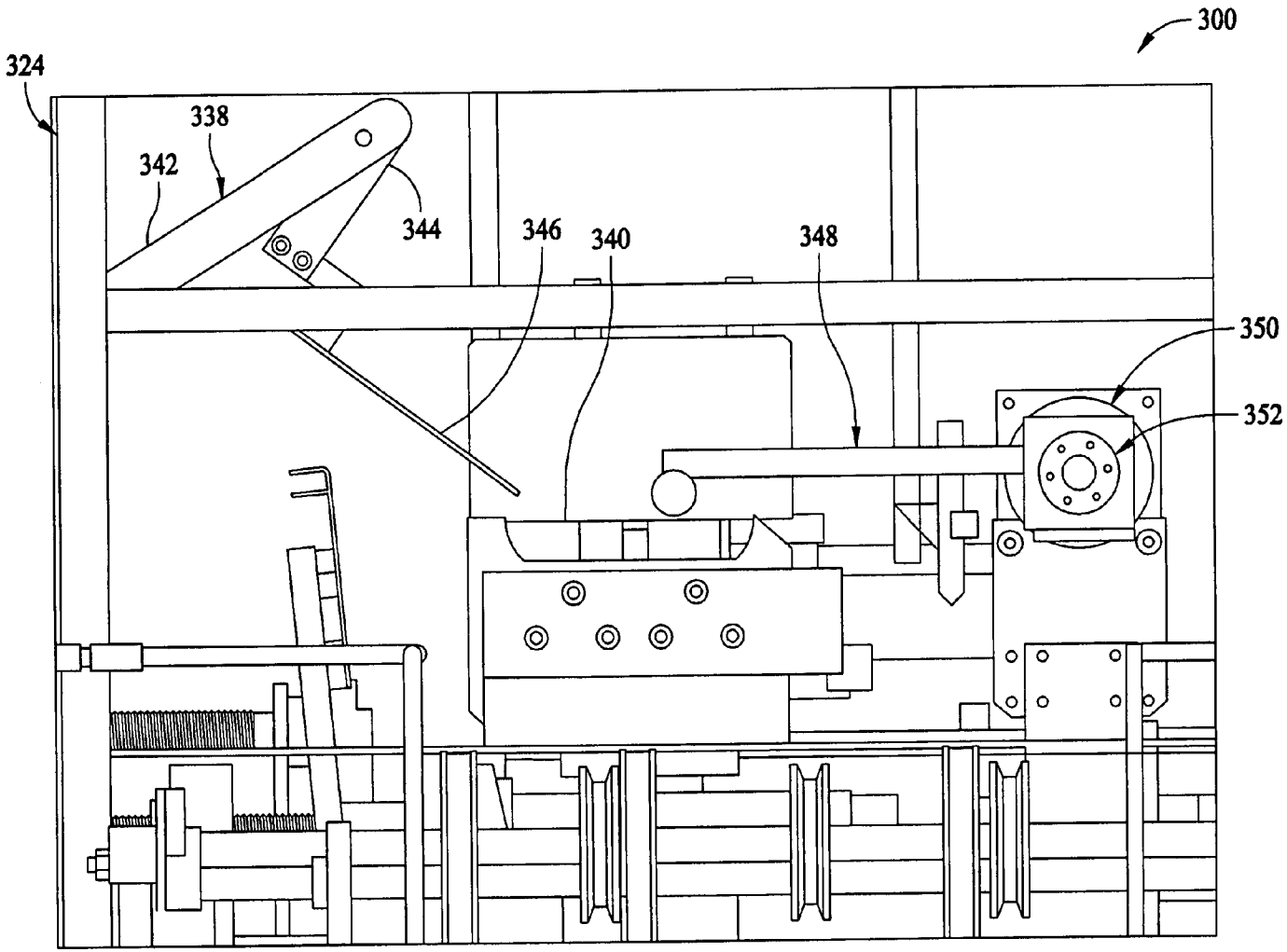
FIG. 16 is a front elevation of a portion of the machine shown in FIG. 4.

As shown in FIGS. 15 and 16, the machine 300 includes a folder member (generally designated by 338) mounted on the body 324 for folding the dispenser panel 110 tight against a top surface 340 of the mandrel 322. Specifically, the folder member 338 includes a first link 342 rotatably mounted on the body 324 for rotation with respect to the body, a second link 344 rotatably mounted to the first link for rotation with respect to the first link, and an extension 346 extending from the second link. The arrangement of the first and second links 342, 344 allow the extension 346 to be driven in a generally forward and a generally downward direction towards the dispenser panel 110 and the top surface 340 of the mandrel 322 to engage the dispenser panel 110 and fold the dispenser panel tight against the top surface 340 of the mandrel 322. The machine 300 also includes a folding arm member (generally designated by 348) that is rotatably mounted on the body 324 for rotation with respect to the body. The folding arm member 348 engages the front panel 22 and wraps the intermediate panel 24 and the front panel 22 around the mandrel 322. Specifically, the folding arm member 348 folds the intermediate panel 24 tight against the mandrel 322 and folds the front panel 22 over the dispenser panel 110 and the top surface 340 such that the front panel 22 is tight against the dispenser panel and the top surface. FIG. 15 generally illustrates the blank 20 as wrapped around the mandrel by the folder member 338 and the folding arm member 348.

As shown in FIG. 16, in one embodiment a servomechanism (generally designated by 350) is operatively connected to the folding member 348 for driving and controlling movement of the folding member. Specifically, the servomechanism 350 facilitates controlling a speed and a position of the folding arm member more accurately and quickly than without the servomechanism. In one embodiment, the servomechanism 350 includes an electric motor (generally designated by 352) for driving rotation of the folding arm member 348 and at least one gear (not shown) for controlling an amount of torque output by the motor. In one embodiment, the folding arm member 348 rotates between about 150° and 210° with respect to the body 324 when folding the front panel 22 against the mandrel 322.

Figure 17:
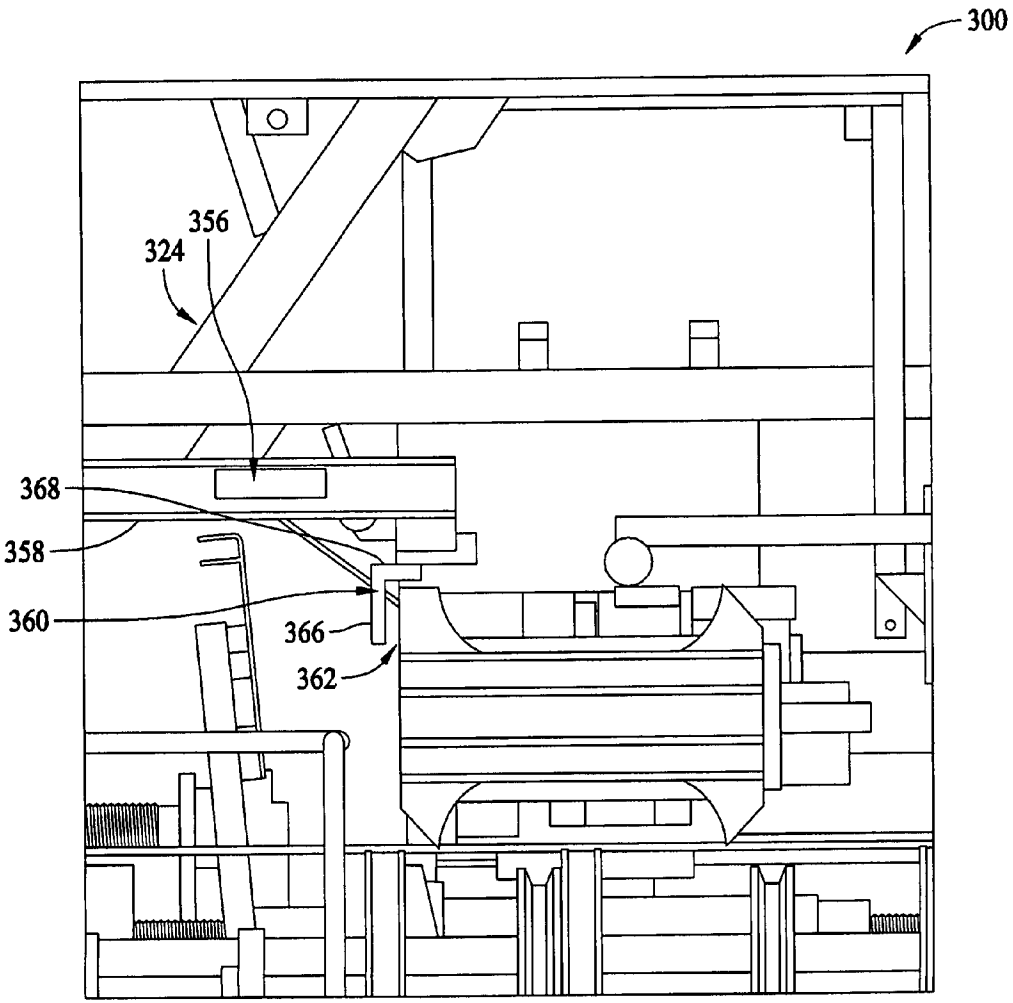
FIG. 17 is a front elevation of a portion of the machine shown in FIG. 4.
Figure 18:
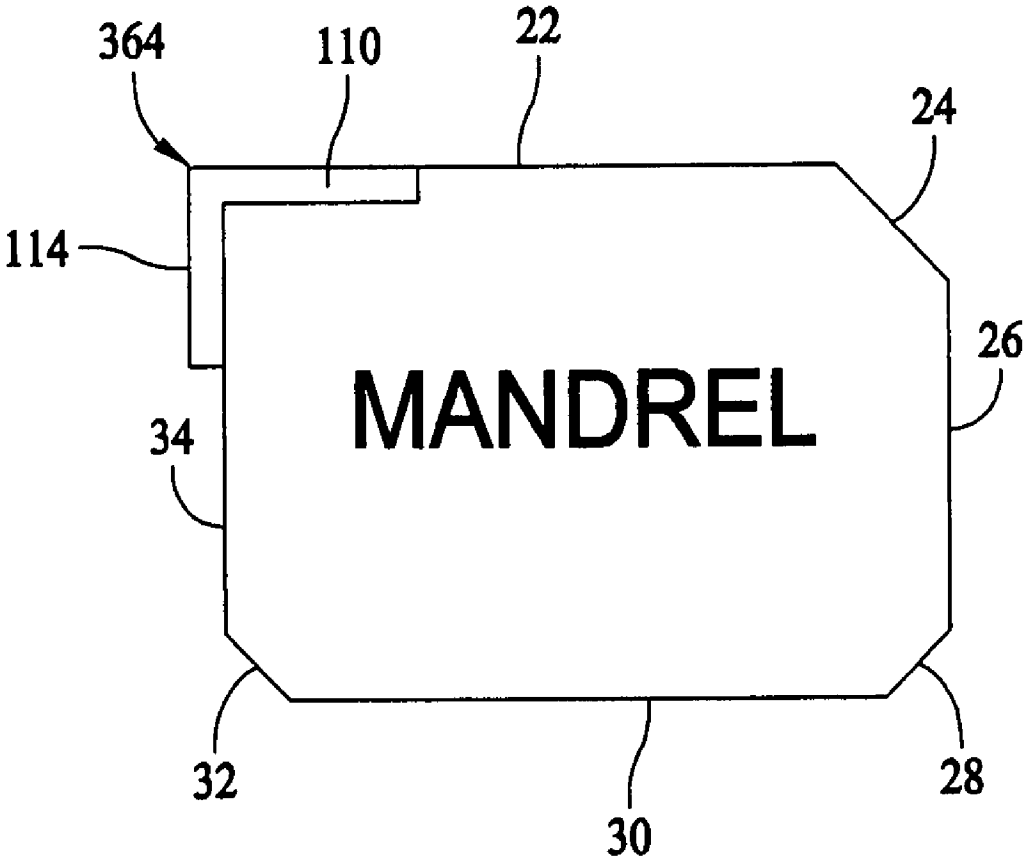
FIG. 18 is a cross section of the mandrel of the machine shown in FIG. 4 illustrating the blank shown in FIG. 1 or 2 wrapped therearound.

As shown in FIGS. 17 and 18, a presser member (generally designated by 356) is rotatably mounted on the body 324 for rotation with respect to the body. The presser member 356 folds the cover flap 114 over a portion of the bottom panel 34 and compresses the adhesive applied to the cover flap 114 to secure the cover flap to the bottom panel. Specifically, the presser member 356 includes an arm 358 rotatably mounted on the body 324 for rotation with respect to the body, and a tool (generally designated by 360) extending from the arm for folding the cover flap and compressing the adhesive between the cover flap 114 and the bottom panel 34. The tool 360 includes a portion (generally designated by 362) that is shaped complimentary to a shape of an external portion (generally designated by 364) of the case 200. Specifically, the tool 360 includes a first extension 366 and a second extension 368. The second extension 368 extends at an angle greater than zero with respect to the first extension 366 such that the first and second extensions are not parallel. Generally, the angle between the first and second extensions 366, 368 at least partially defines the portion 362 of the tool that is complimentary-shaped to the external portion 364 of the case 200. Of course, the particular angle between the first and second extensions 366, 368 will depend upon the shape of the external portion 364 of the case 200. As shown in FIG. 18, the front panel 22 and the cover flap 114 are generally perpendicular to each other in the embodiments illustrated and described herein and so the first and second extensions 366, 368 (shown in FIG. 17) are angled at about 90° with respect to each other. Of course, the first and second extensions 366, 368 may have other angles and/or shapes from those described and/or illustrated herein without departing from the scope of the present invention.

Figure 19:
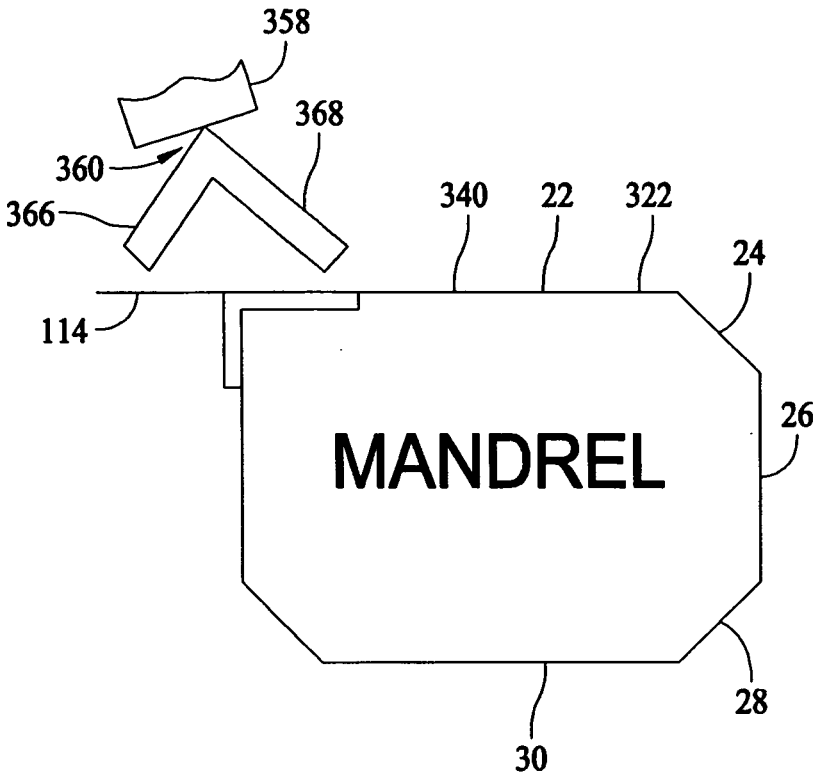
FIG. 19 is a cross section of the mandrel of the machine shown in FIG. 4 illustrating an exemplary embodiment of a tool for wrapping the blank shown in FIG. 1 or 2 around the mandrel.
Figure 19:
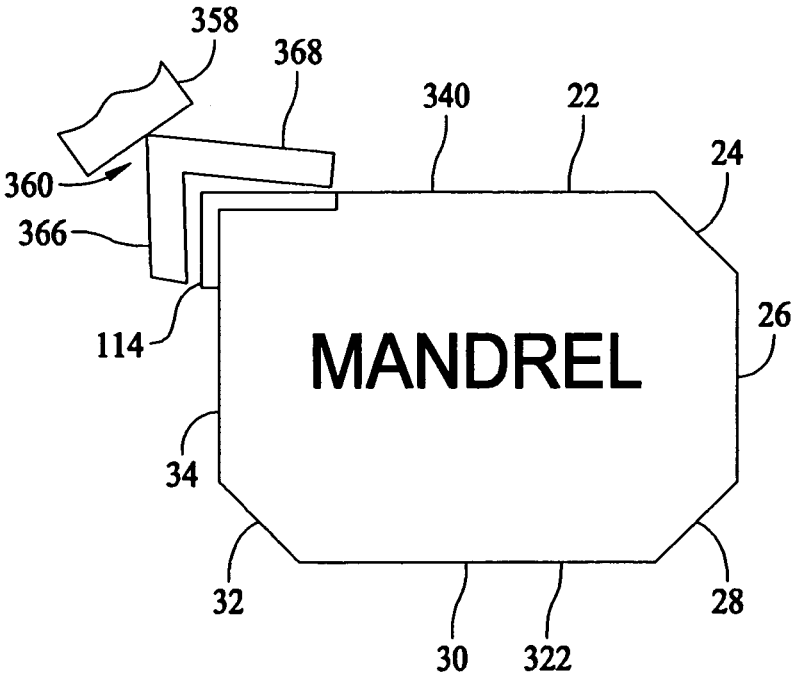
Figure 20:
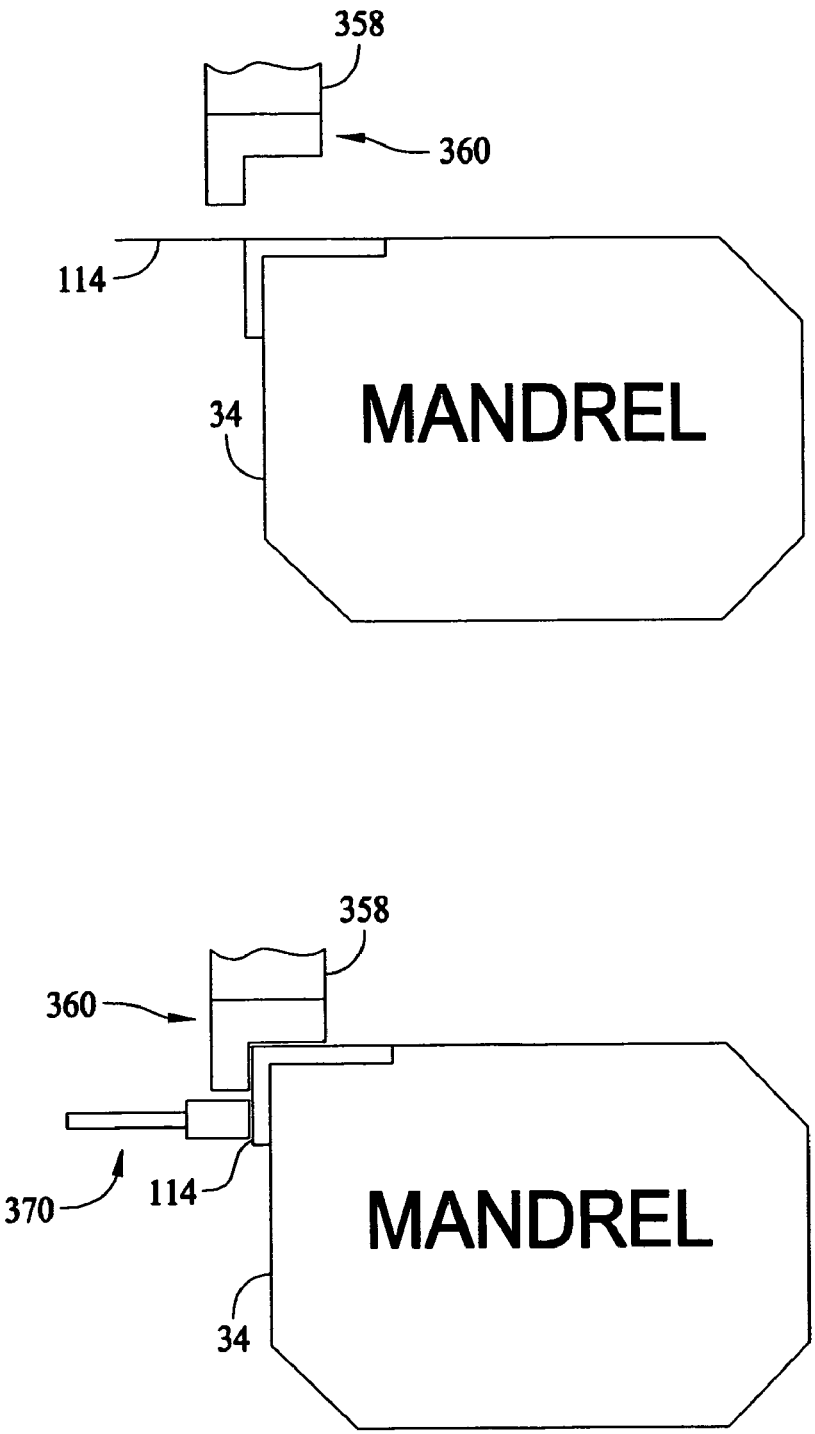
FIG. 20 is a cross section of the mandrel of the machine shown in FIG. 4 illustrating an exemplary embodiment of a tool for wrapping the blank shown in FIG. 1 or 2 around the mandrel.

In the embodiment shown in FIG. 17, the tool 360 is generally fixedly mounted on the arm 358 such that the tool 360 generally does not move with respect to the arm 358. However, in an alternative embodiment the tool 360 is rotatably mounted on the arm 358 for rotation with respect to the arm. For example, as shown in FIG. 19, as the tool 360 moves towards the mandrel 322 the second extension 368 contacts the front panel 22 over the top surface 340 of the mandrel causing the tool to rotate with respect to the arm 358 such that the first extension 366 is forced against the cover flap 114 to compress the adhesive between the cover flap 114 and the bottom panel 34. The rotating tool 360 embodied in FIG. 19 may facilitate applying a greater compression force against the cover flap 114 than the embodiment illustrated in FIG. 17. In another embodiment illustrated in FIG. 20, another presser member (generally designated by 370) is used in combination with a tool 360 that is fixedly mounted to the arm 358, similar to the tool 360 embodied in FIG. 17. The presser member 370 is movably mounted on the body 324 for movement with respect to the body and the mandrel 322. The tool 360 folds the cover flap 114 over the bottom panel 34 and holds the cover flap in place as the presser member 370 moves to contact the cover flap and compress the adhesive between the cover flap and the bottom panel. Although the presser member 370 may include any suitable device for moving with respect to the body 324 and the mandrel 322 to compress the cover panel 114 without departing from the scope of the present invention, in one embodiment the presser member 370 includes at least one of a hydraulic and a pneumatic cylinder.

Figure 21:
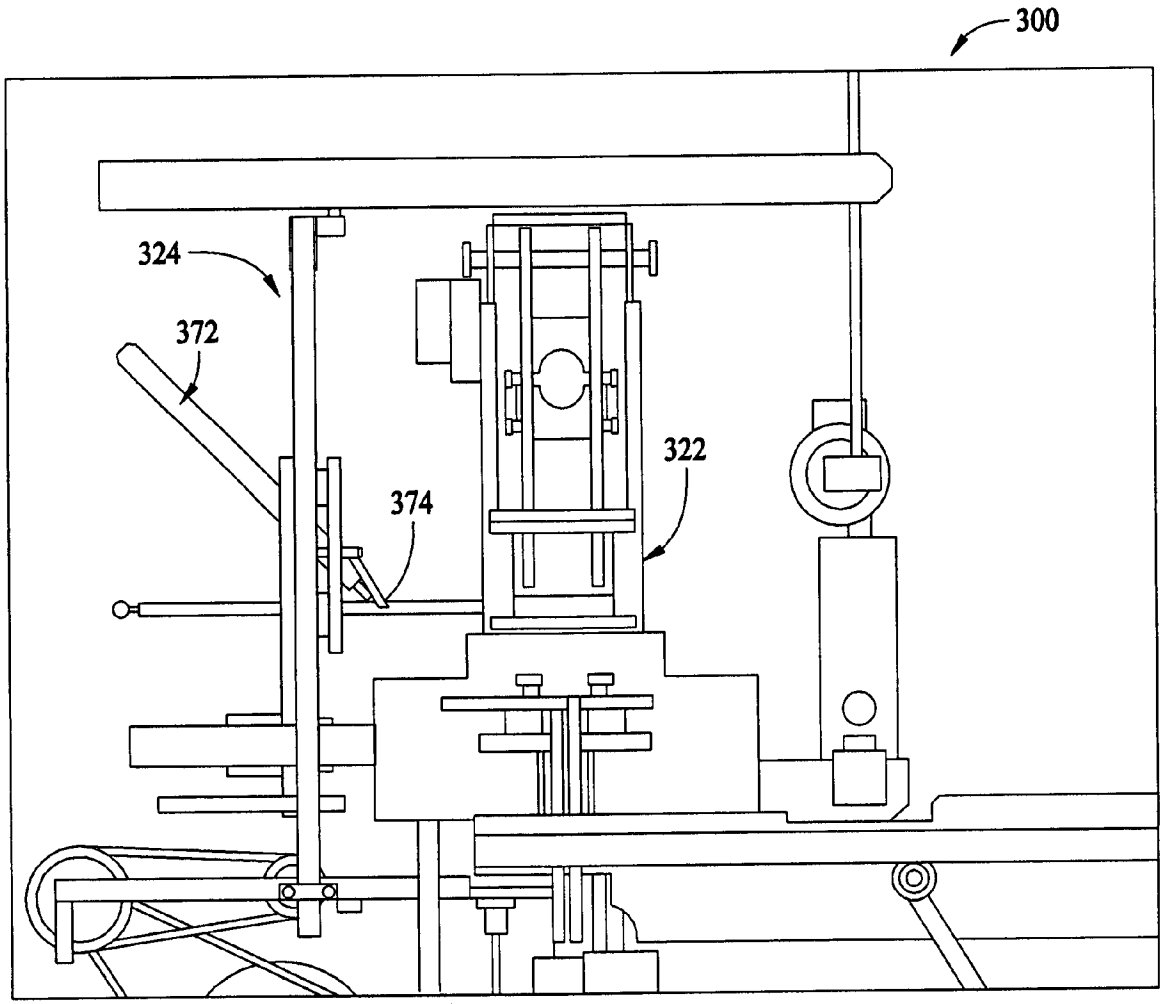
FIG. 21 is a side elevation of a portion of the machine shown in FIG. 4.

As shown in FIG. 21, the machine 300 includes a flap folder member (generally designated by 372) for folding front flap 48 tight against the mandrel 322. More specifically, the flap folder member 372 is movably mounted to the body 324 and an end 374 of the flap folder member 372 engages the front flap 48 and folds the front flap 48 along the fold line 52 until the front flap is tight against the mandrel 322. As the front flap 48 is folded along fold line 52, it engages dispenser flap 138 such that dispenser flap 138 is folded along fold line 142 and such that dispenser flap portion 146 is at least partially received within bottom flap slot 150.

Figure 22:
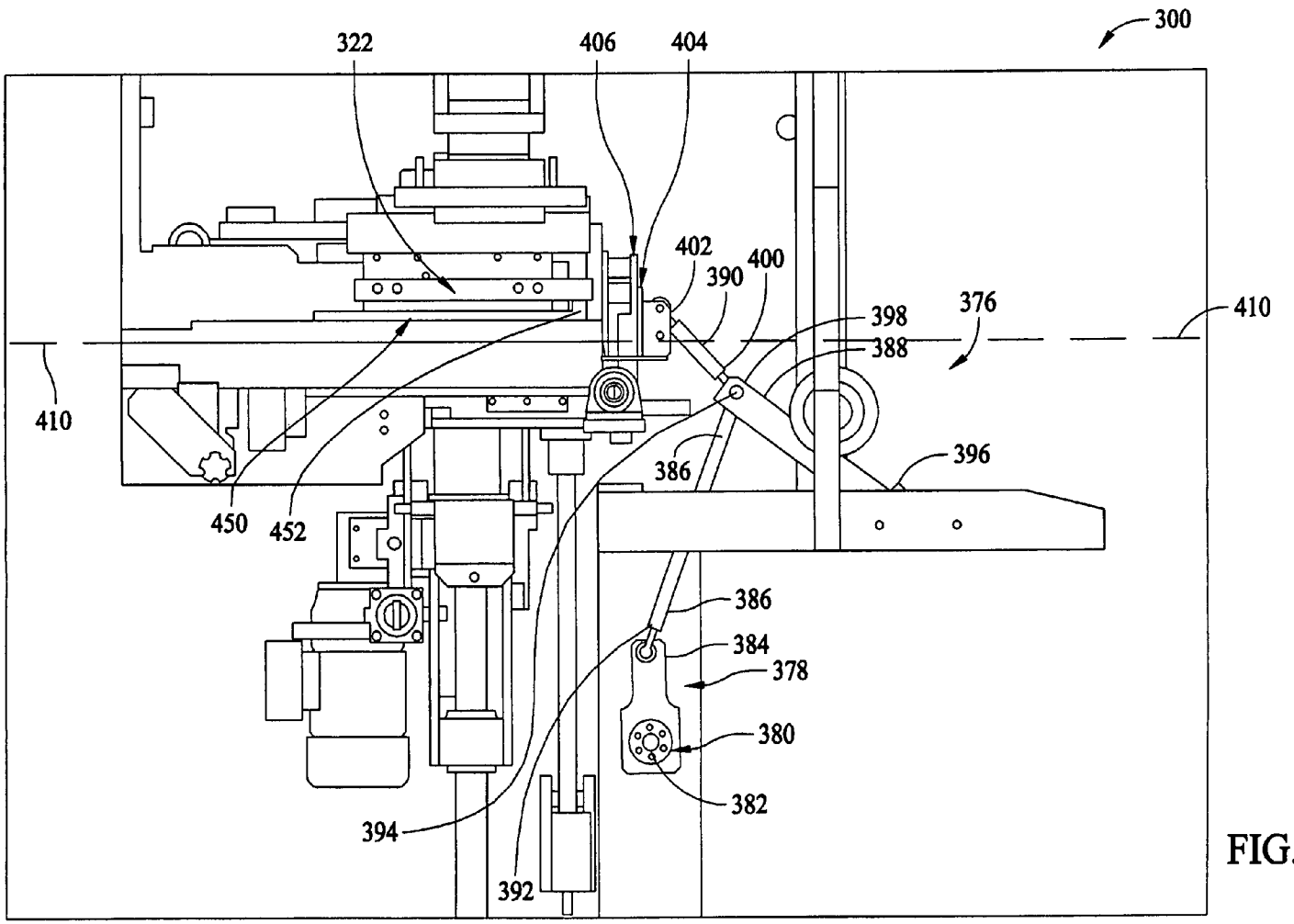
FIG. 22 is a side elevation of a portion of the machine shown in FIG. 4.

Once the front flap 48 has been folded tight against the mandrel 322, the back flap 56 is folded tight and secured to the mandrel 322. Specifically, as shown in FIG. 22 the machine 300 includes a bottom presser member (generally designated by 376) mounted on the body 324 adjacent the mandrel 322 for folding the back flap 56 about the fold line 60. The bottom presser member 376 includes a servomechanism (generally designated by 378) for driving and controlling movement of the member 376. In one embodiment, the servomechanism 376 includes an electric motor (generally designated by 380) having an output shaft 382. Bottom presser member 376 may have include suitable structure and/or arrangement and/or configuration of such structure for providing a pressing component 404 be selectively positionable, sometimes referred to as toggled, between a first position 406 and a second position 408, as is described in more detail below. For example, in the exemplary embodiment, bottom presser member 376 includes a first link 384 connected to the output shaft 382 for rotation with the shaft, a second link 386, a third link 388, and a fourth link 390. The second link 386 has a first end 392 rotatably connected to the first link 384 and a second end 394 opposite the first end. The third link 388 has a first end 396 rotatably mounted on the body 324 and a second end 398 opposite the first end. The second end 398 of the third link 388 is rotatably connected to the second end 394 of the second link 386. The fourth link 390 has a first end 400 rotatably connected to the second end 394 of the second link 386 and the second end 398 of the third link 388. A second end 402 of the fourth link 390 is connected to a pressing component (generally designated by 404).

The pressing component 404 is selectably positionable, sometimes referred to as toggled, between a first position (generally designated by 406 and shown in FIG. 21) wherein the pressing component 404 not apply a force to the blank, and more specifically the back flap 56, and a second position (generally designated by 408 and shown in FIG. 23) wherein the pressing component applies a force to the back flap to compress adhesive between the back flap and the top and bottom flaps 122, 130. Specifically, rotation of the output shaft 382 of the motor 380 causes relative movement between the first, second, third, and fourth links 384, 386, 388, 390, respectively, to move the pressing component 404 between the first position 406 and the second position 408. Although other ranges of movement may be used without departing from the scope of the present invention, in one embodiment the first and second positions 406, 408, respectively, are separated by between about 70° and 90° of rotation. Moreover, although other ranges of movement may be used without departing from the scope of the present invention, in one embodiment output shaft 382 of the electric motor 380 rotates between about 180° and 240° between the first position 406 of the pressing component and the second position 408.

Figure 23:
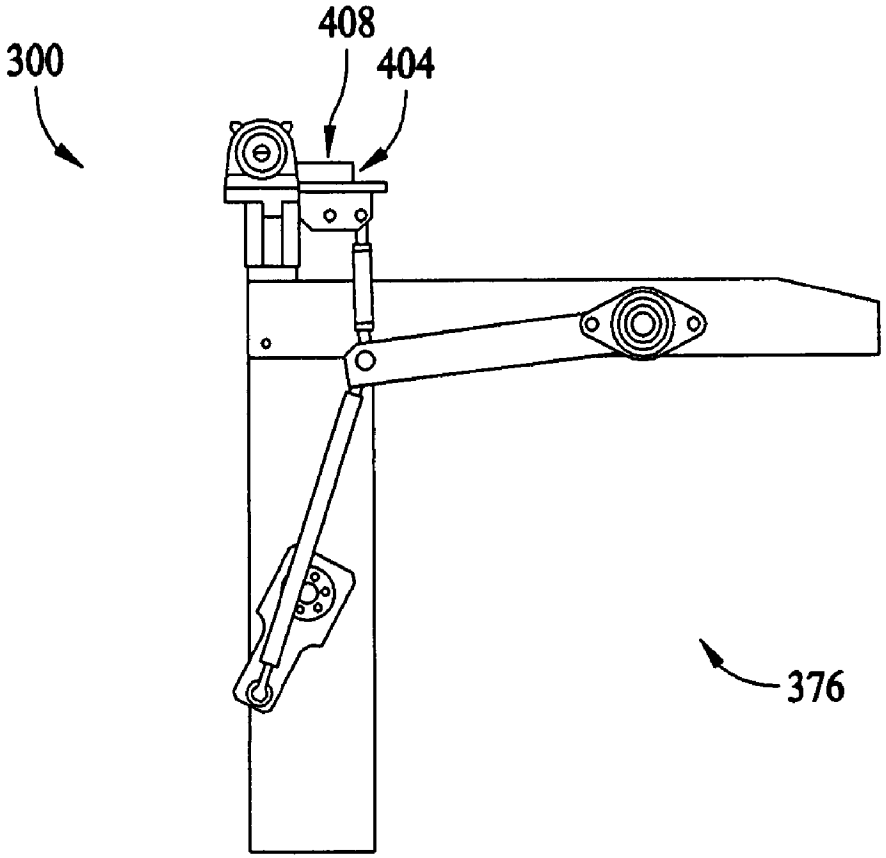
FIG. 23 is a side elevation of an exemplary embodiment of a portion of a bottom presser member of the machine shown in FIG. 4.
Figure 24:
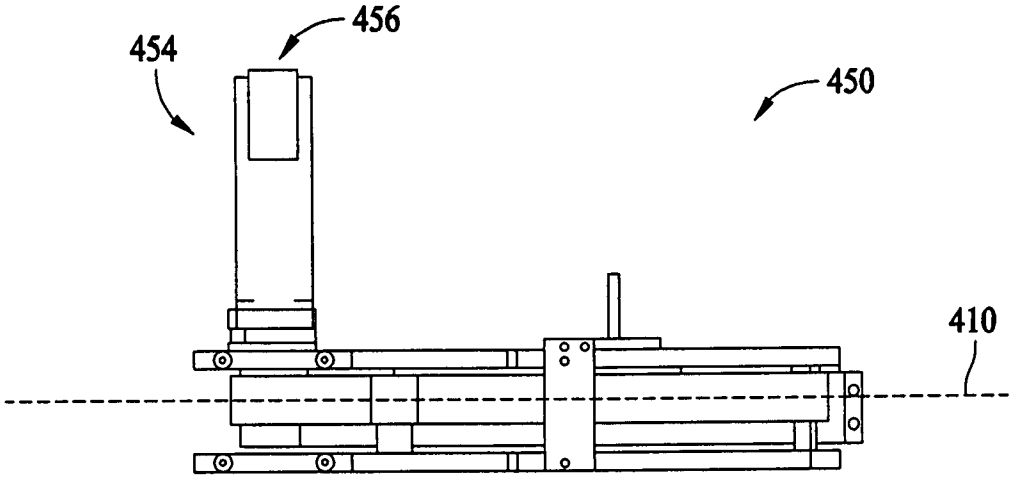
FIG. 24 is a side elevation of an exemplary embodiment of an ejection mechanism of the machine shown in FIG. 4.
Figure 25:
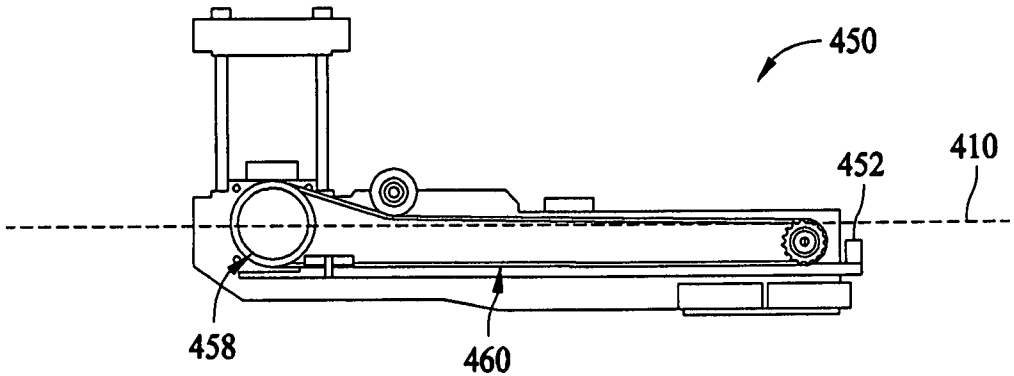
FIG. 25 is another side elevation of the ejection mechanism shown in FIG. 24.

Once the front and back flaps 48, 56, respectively, are secured to the top and bottom flaps 122, 130, respectively, the case 200 is formed except for flaps 140, 132, 58, 124, 50, which may be closed (and in some embodiments secured with an adhesive) after filling case 200 with a substance. Case 200 can then be ejected from mandrel 322 and machine 300. Although case 200 may be ejected from mandrel 322 and machine 300 using any suitable mechanism, structure, and/or means, in the exemplary embodiment machine 300 includes an ejection plate mechanism (generally designated by 450) having an ejection plate 452 positioned at least partially between the mandrel 322 and the back flap 56, the top flap 122, and/or the bottom flap 130 that applies a force to an interior surface of the back flap 56, top flap 122, and/or bottom flap 130 to eject the case 200 from the mandrel 322. More specifically, and as shown in FIGS. 22, 23, and 25, the ejection plate 452 is movable along an axis 410 in a direction away from the mandrel 322 to eject the case 200 from the mandrel 322 and the machine 300. Although the ejection plate 452 may move any distance along axis 410, in some embodiments the ejection plate moves between about 10 and about 30 inches along axis 410 to eject the case 200 from the mandrel 322 and the machine 300. In some embodiments, compression between the ejection plate and the bottom presser member pressing component 404 facilitates compressing adhesive between the back flap 56 and the top and bottom flaps 122, 130, respectively. For example, in some embodiments the ejection plate applies a force to the back flap 56, the top flap 122, and/or the bottom flap 130 to facilitate compressing the adhesive.

In some embodiments, ejection mechanism 450 includes a servomechanism (generally designated by 454) for driving and controlling movement of the ejection plate 452. Specifically, the servomechanism 454 may facilitate controlling a speed and a position of the ejection plate 452 more accurately and quickly than without the servomechanism 454. In the exemplary embodiment, the servomechanism 454 includes an electric motor (generally designated by 456) that includes an output shaft (generally designated by 458) for driving rotation of a conveyor (generally designated by 460) coupled to the ejection plate 452.

As used herein, any of the gripping member 310, the pusher assembly 316, the lifting assembly 326, the flap folder member 334, the folder member 338, the folding arm member 348, the presser member 356, the flap folder member 372, the bottom presser member 376, any other member described and/or illustrated herein, and/or components thereof may be referred to herein as a member, a first member, a second member, and/or a third member.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

While the invention has been described in terms of various specific embodiments, those skilled in the art will recognize that the invention can be practiced with modification within the spirit and scope of the claims.

What is claimed is:

1. A machine for forming a case from a blank of sheet material, the blank having a plurality of panels including a first panel, a second panel, and a third panel for forming at least one of a back wall, a top wall, and a front wall of the case, the blank extending in a longitudinal direction, said machine comprising:

a frame;

a mandrel fixedly mounted on the frame, said mandrel comprising a plurality of faces including seven faces along a cross section of the mandrel, the cross section defined by a center plane extending in the longitudinal direction and perpendicular to a first face of the mandrel, said mandrel faces defining an external shape complimentary to an internal shape of at least a portion of the case;

a lifting mechanism comprising a pressure plate, the lifting mechanism configured to position the blank proximate the mandrel with the first panel substantially aligned with the first face of the mandrel, the pressure plate configured to direct the first panel toward the first face and hold the first panel against the first face;

a body member movably mounted to the frame;

a first rotating member rotatably mounted to the body member adjacent the mandrel for applying a controlled force to the blank for folding a portion of the blank around the mandrel including folding the second panel into face-to-face contact with second face of the mandrel and folding the third panel into face-to-face contact with a third face of the mandrel, the first rotating member applying the controlled force to the blank by rotating about a rotational axis; and a first servomechanism operatively connected to the first rotating member for rotating the first rotating member relative to the body member in a first direction at a first rotational speed and in a second direction opposite the first direction, the first servomechanism configured to control and vary the first rotational speed of the first rotating member to apply the controlled force to the blank to facilitate wrapping the second panel and the third panel around the mandrel.

2. A machine in accordance with claim 1 wherein the first servomechanism comprises an electric motor and a gear for controlling an amount of torque output by the electric motor.

3. A machine in accordance with claim 1 wherein the first rotating member is selectably positionable between an unengaged position relative to the body member wherein the first rotating member does not apply the controlled force to the blank and an engaged position relative to the body member wherein the first rotating member applies the controlled force to the blank.

4. A machine in accordance with claim 1 further comprising a presser assembly rotatably coupled to said frame, the presser assembly comprising a second servomechanism having an electric motor and an output shaft, the presser assembly further comprising:

a first link mounted on the frame and connected to the output shaft for rotation with the shaft;

a second link extending from the first link and having a first end rotatably connected to the first link and a second end opposite the first end;

a third link having a first end and a second end opposite the first end, wherein the first end of the third link is rotatably mounted on said frame and the second end of the third link is rotatably connected to the second end of the second link; and a fourth link having a first end and a second end, wherein the first end of the fourth link is rotatably connected to the second end of the second link and the second end of the third link, and wherein the second end of the fourth link is connected to a presser plate such that rotation of the output shaft of the electrical motor causes relative movement between the first, second, third, and fourth links to move the presser plate between a first position and a second position.

5. A machine in accordance with claim 1 further comprising an ejection member mounted on said frame adjacent an interior surface of the case, the ejection member configured to apply an ejection force to the interior surface of the case for ejecting the case from the mandrel.

6. A machine in accordance with claim 1 further comprising a second rotating member rotatably mounted adjacent the mandrel for applying a second force to the blank for folding a portion of the blank around the mandrel, the second rotating member selectably rotatable about a second rotational axis for a range of rotation from a first position to a second position, the second member comprising a tool that includes a shape that is complementary to an external shape of a portion of the case.

7. A machine in accordance with claim 6 wherein the blank further includes a fourth panel for forming a bottom wall of the case, and wherein the second rotating member further comprises an arm and the tool, the tool further comprises a first extension and a second extension that are rotatably coupled to the arm, the second extension rotatable towards the mandrel to wrap the fourth panel of the blank around the fourth face of the mandrel.

8. A machine in accordance with claim 1 further comprising:

an adhesive dispenser configured to apply adhesive to a surface of the blank before the blank is folded; and a pusher assembly configured to guide the blank over the adhesive dispenser and position the blank with the adhesive proximate the mandrel.

9. A machine in accordance with claim 1 further comprising:

a loading section configured to support the blank in a generally vertical position; and a gripping member configured to rotate the blank from the generally vertical position to a generally horizontal position, the blank positioned beneath the mandrel while in the generally horizontal position.

10. A machine in accordance with claim 1, wherein the first servomechanism is configured to adjustably control the first rotating member by electrically controlling the movement of the first rotating member to apply a variable force to the blank.

11. A machine in accordance with claim 1, wherein the first servomechanism is configured to electrically control an angle between the first rotating member and the body member as the first rotating member is rotated by the first servomechanism between a first position and a second position, wherein the first position includes the first rotating member proximate the blank but not directly contacting the blank, and wherein the second position includes the first rotating member proximate the third face of the mandrel, the first rotating member wrapping the second panel and the third panel around the mandrel as the first rotating member rotates between the first position and the second position.

12. A machine in accordance with claim 1 wherein the third face of the mandrel is located opposite the pressure plate and extends in a direction that is substantially parallel to the pressure plate, and wherein the first servomechanism is further configured to electrically control an angle of rotation of the first rotating member in the first direction, the angle of rotation extending between a first position of the first rotating member and a second position of the first rotating member, wherein the first position includes the first rotating member proximate the blank but not directly contacting the blank, and wherein the second position includes the first rotating member proximate the third face of the mandrel, the first rotating member wrapping the second panel and the third panel around the mandrel as the first rotating member rotates between the first position and the second position.

13. A machine in accordance with claim 12 wherein the first rotating member comprises a first end rotatably mounted to the body member and a second end opposite the first end, the first servomechanism further configured to electrically control the angle of rotation of the first rotating member to position the second end of the first rotating member a predetermined distance from the third face of the mandrel, wherein the predetermined distance positions the third panel of the blank in face-to-face contact with the third face of the mandrel without the first rotating member contacting the mandrel.

14. A machine for forming a case from a blank of sheet material, the blank having a plurality of panels including a first panel, a second panel, and a third panel for forming at least one of a back wall, a top wall, and a front wall of the case, the blank extending in a longitudinal direction, said machine comprising:

a frame;

a mandrel fixedly mounted on the frame, wherein the mandrel comprises a plurality of exterior faces and being complimentary to an internal shape of at least a portion of the case;

a lifting mechanism comprising a pressure plate, the lifting mechanism configured to position the blank proximate the mandrel with the first panel substantially aligned with a first face of the mandrel, the pressure plate configured to direct the first panel toward the first face and hold the first panel against the first face;

a body member moveably mounted to the frame;

a folding member rotatably mounted to the body member adjacent the mandrel for applying a force to the blank for folding a portion of the blank around the mandrel including folding the second panel into face-to-face contact with a second face of the mandrel and folding the third panel in face-to-face contact with a third face of the mandrel, the folding member applying the force to the blank by rotating about a rotational axis; and a first servomechanism operatively connected to the folding member for driving and controlling movement of the folding member relative to the body member to apply the force to the blank to wrap the second panel and the third panel around the mandrel, wherein the plurality of faces of the mandrel further comprises seven faces along a cross section of the mandrel, the cross section defined by a center plane extending in the longitudinal direction and perpendicular to the first face of the mandrel.

15. A method for forming a case from a blank of sheet material using a machine, the blank including a plurality of panels including at least seven panels for forming at least one of a back wall, a top wall, and a front wall of the case, the blank extending in a longitudinal direction, the machine including a frame, a mandrel fixedly mounted on the frame, the mandrel comprising a plurality of faces including at least seven faces along a cross section of the mandrel, the cross section defined by a center plane extending in the longitudinal direction and perpendicular to a first face of the mandrel, the mandrel faces defining an external surface having a shape complimentary to an internal shape of at least a portion of the case, the machine further including a lifting mechanism comprising a pressure plate, the lifting mechanism configured to position the blank proximate the mandrel with a first panel substantially aligned with the first face of the mandrel, the machine including a body member moveably mounted to the frame and at least one rotating member rotatably mounted to the body member adjacent the mandrel, and a servomechanism operatively connected to the at least one rotating member, said method comprising:

aligning the first panel of the at least seven panels of the blank with the first face of the at least seven faces of the fixed mandrel;

directing the aligned first panel toward the first face of the at least seven faces of the mandrel by engaging the blank with the pressure plate of the lifting mechanism;

securing the first panel of the at least seven panels of the blank against the first face of the at least seven faces of the mandrel with the pressure plate of the lifting mechanism;

applying a controlled force to the blank with the at least one rotating member to fold at least a second, third, fourth, fifth, sixth, and seventh panels of the at least seven panels of the blank into face-to-face contact with at least a corresponding second, third, fourth, fifth, sixth, and seventh faces of the at least seven faces of the mandrel, the at least one rotating member applying the controlled force to the blank by rotating about a rotation axis; and rotating and controlling movement of the at least one rotating member relative to the body member in a first direction at a first rotational speed and in a second direction opposite the first direction with the servomechanism, the servomechanism controls the movement by varying the first rotational speed of the at least one rotating member to apply the controlled force to the blank to facilitate wrapping the at least seven panels around the at least seven faces of the mandrel.

16. A method for forming a case from a blank of sheet material using a machine, the blank including a plurality of panels extending in a longitudinal direction and including a first panel, a second panel, and a third panel, for forming at least one of a back wall, a top wall, and front wall of the case, the machine including a frame, a mandrel fixedly mounted on the frame, a body member moveably mounted to the frame, and a rotating member rotatably mounted to the body member adjacent the mandrel, the machine further including a lifting mechanism comprising a pressure plate, the lifting mechanism configured to position the blank proximate the mandrel with the first panel substantially aligned with a first face of the mandrel, said method comprising:

providing the mandrel having seven exterior faces along a cross section of the mandrel, the cross section defined by a center plane extending in the longitudinal direction and perpendicular to the first face of the mandrel, the faces of the mandrel are complimentary to an internal shape of at least a portion of the case;

aligning the first panel of the blank with the first face of the seven faces of the fixed mandrel;

directing the aligned first panel toward the first face of the mandrel by engaging the blank with the pressure plate of the lifting mechanism;

securing the first panel of the blank against the first face of the mandrel with the pressure plate of the lifting mechanism;

applying a controlled force to the blank with the rotating member to fold the second panel of the blank into face-to-face contact with a second face of the mandrel and to fold the third panel of the blank into face-to-face contact with a third face of the mandrel, the rotating member applying the controlled force to the blank by rotating about a rotational axis; and initiating and controlling movement of the rotating member with respect to the body member with a servomechanism to apply the controlled force to the blank to wrap the second and third panels around the second and third faces of the mandrel.

17. A machine for forming a case from a blank of sheet material, the blank comprising: a front panel; a top panel coupled to the front panel; a back panel coupled to the top panel; an intermediate panel extending from the back panel along a first fold line; a bottom panel extending from the intermediate panel along a second fold line; a flap extending from the back panel along a third fold line, wherein the flap has a length taken along a longitudinal axis of said blank that is greater than a length of the back panel taken along the longitudinal axis, wherein the flap forms at least a portion of a side of the formed dispensing case; and a dispenser panel extending from the bottom panel along a fourth fold line; said machine comprising:

a frame;

a body member moveably mounted to the frame;

a mandrel mounted on the frame and having an external shape complimentary to an internal shape of at least a portion of the case, wherein the mandrel has seven exterior faces along a cross section of the mandrel, the cross section defined by a center plane extending along the longitudinal axis and perpendicular to a first face of the mandrel;

a lifting mechanism coupled on the frame for lifting the blank and positioning the back panel of the blank substantially adjacent to and tight against the first face of the mandrel;

a folding member rotatably mounted to the body member adjacent the mandrel for applying a controlled force to the blank for folding the top panel and the front panel of the blank around a second face and a third face of the mandrel; and a servomechanism operatively connected to the folding member for rotating the folding member relative to the body member in a first direction at a first rotational speed and in a second direction opposite the first direction, the servomechanism configured to control and vary the first rotational speed of the folding member to apply the controlled force to the blank to facilitate wrapping the top panel and the front panel around the mandrel.

18. A machine in accordance with claim 17 further comprising a second folding member rotatably mounted on the body member, the second folding member rotatably mounted on the body member for rotation with respect to the body member and the mandrel for moving the second folding member into contact with the blank for applying a force to the blank for folding the bottom panel of the blank around the mandrel.

19. A machine in accordance with claim 17 further comprising a rotating arm member, wherein the rotating arm member comprises an arm and a tool extending from the arm, the arm rotatably mounted on the frame for rotation with respect to the frame and the mandrel for moving the tool into contact with the blank for folding the bottom panel of the blank around the mandrel.

20. A machine in accordance with claim 1 further comprising a folder member rotatably coupled to the frame, the folder member comprising:

a first link rotatably mounted on the frame;

a second link rotatably mounted to the first link for rotation with respect to the first link; and a third link rotatably mounted to the second link, the third link applies force to the blank to wrap at least a portion of the blank about a portion of the mandrel.

* * * * *